US010942470B2

(12) United States Patent
Fujino et al.

(10) Patent No.: US 10,942,470 B2
(45) Date of Patent: Mar. 9, 2021

(54) DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Hirokazu Fujino, Mishima (JP); Naoki Fukushima, Mishima (JP); Atsushi Toda, Fuji (JP); Daisuke Baba, Mishima (JP); Yosuke Kishi, Suntou-gun (JP); Masahito Kato, Suntou-gun (JP); Masaki Hirose, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/416,399

(22) Filed: May 20, 2019

(65) Prior Publication Data

US 2019/0361370 A1 Nov. 28, 2019

(30) Foreign Application Priority Data

May 23, 2018 (JP) ..... 2018-098745

(51) Int. Cl.
*G03G 15/08* (2006.01)
*G03G 15/09* (2006.01)

(52) U.S. Cl.
CPC ..... *G03G 15/0812* (2013.01); *G03G 15/0921* (2013.01)

(58) Field of Classification Search
None
See application file for complete search history.

(56) References Cited

U.S. PATENT DOCUMENTS 5,095,850 A * 3/1992 Komuro ..... G03G 15/0806 399/117
2001/0038763 A1* 11/2001 Aoki ..... G03G 15/0808 399/267
2004/0141772 A1* 7/2004 Goto ..... G03G 9/0819 399/222
2011/0274468 A1* 11/2011 Itagaki ..... G03G 15/0808 399/254

FOREIGN PATENT DOCUMENTS

JP H0854785 A 2/1996

* cited by examiner

*Primary Examiner* — Roy Y Yi
(74) *Attorney, Agent, or Firm* — Rossi, Kimms & McDowell LLP

(57) ABSTRACT

A developing apparatus, includes: a developer bearing member that encloses a magnet roller having a plurality of magnetic poles and is rotatable; a wall that forms a developer storing chamber for storing a magnetic developer therein; a restricting member configured to restrict a layer thickness of the magnetic developer carried by the developer bearing member; and a moving member configured to move the magnetic developer carried by the developer bearing member before the magnetic developer is restricted by the restricting member, the moving member being brought into contact with a surface of the developer bearing member, the moved developer being on the developer veering member after the moving member moved the developer on the developer bearing member, wherein the moving member is disposed at a position opposed to any of the magnetic pole positions of the plurality of magnetic poles.

15 Claims, 28 Drawing Sheets

(MEASUREMENT RESULT A OF BRUSH CURRENT I)

| | | | |
|---|---|---|---|
| RESTRICTION FAILURE | – | ○ | △ |

(MEASUREMENT RESULT B OF BRUSH CURRENT I)

| | | |
|---|---|---|
| RESTRICTION FAILURE | ○ | △ |

DEVELOPING APPARATUS, PROCESS CARTRIDGE, AND IMAGE FORMING APPARATUS

BACKGROUND OF THE INVENTION

Field of the Invention

The present invention relates to a developing apparatus, a process cartridge, and an image forming apparatus.

Description of the Related Art

Conventionally, an electrophotographic image forming apparatus using a magnetic single-component developing configuration includes magnetic toner, a developing roller for bearing the magnetic toner, a fixed magnet disposed in the developing roller, and a developing blade for restricting the magnetic toner on the surface of the developing roller to a predetermined toner layer. These components are used to develop toner onto an electrostatic latent image formed on the photosensitive drum. The magnetic toner on the surface of the developing roller is present in the form of chains (hereinafter referred to as "magnetic chains") by a magnetic field of a fixed magnet, and is frictionally charged when restricted by the developing blade to obtain charge amount necessary for image formation.

However, the charge amount of toner needs to be increased in order to improve development responsiveness of latent images due to the recent increase in speed and image quality of image forming apparatuses. However, there is a problem in that the toner having high charge amount may be increased in electrostatic attachment force and easily stick to the developing roller surface and it is thus more difficult to restrict the toner by the developing blade.

As countermeasures for the problem, before the toner sticking to the developing roller surface is restricted by the developing blade, a stripping member such as a fur brush and a sponge roller has conventionally been brought into contact with the developing roller to strip the toner sticking to the developing roller surface.

It is known that a fur brush is brought into contact with a region where the magnetic field of a fixed magnet is weak (not a magnetic pole position where magnetic field is strong but an interpole region between adjacent magnetic poles) to improve cleaning (stripping) performance (Japanese Patent Application Publication No. H08-54785).

In the configuration in which the fur brush or the sponge roller is brought into contact with the developing roller to strip the toner, the stripping member mechanically rubs the toner, and hence there is a problem in that physical properties of the toner may change due to a peeled or buried external additive. As a result, a problem in that the charge amount of toner decreases to cause fogging or density decrease. This problem is particularly conspicuous when mono-component magnetic toner (developer) is used. The mono-component magnetic toner (developer) is used for, for example, jumping development in non-contact development.

SUMMARY OF THE INVENTION

In order to achieve the object described above, a developing apparatus, including:

a developer bearing member that encloses a magnet roller having a plurality of magnetic poles and is rotatable;

a wall that forms a developer storing chamber for storing a magnetic developer therein;

a restricting member configured to restrict a layer thickness of the magnetic developer carried by the developer bearing member; and a moving member configured to move the magnetic developer carried on the developer bearing member before the magnetic developer is restricted by the restricting member, the moving member being brought into contact with a surface of the developer bearing member, the moved developer being on the developer bearing member after the moving member moved the developer on the developer bearing member, wherein the moving member is disposed at a position opposed to any of the magnetic pole positions of the plurality of magnetic poles.

Further features of the present invention will become apparent from the following description of exemplary embodiments with reference to the attached drawings.

DESCRIPTION OF THE EMBODIMENTS

Embodiments of the present invention are exemplified below with reference to the accompanying drawings. The dimensions, materials, shapes, and relative arrangement of components described in the embodiments should be appropriately changed depending on the configuration and various conditions of an apparatus to which the invention is applied, and are not intended to limit the scope of the invention to the following embodiments.

First Embodiment

In the first embodiment, modes for embodying the invention are described in the following order:

1. Outline of image forming apparatus;
2. Configuration of developing apparatus including moving member;
3. Movement of magnetic chain; and
4. Method of verifying movement.

Description of Image Forming Apparatus

Figure 1:
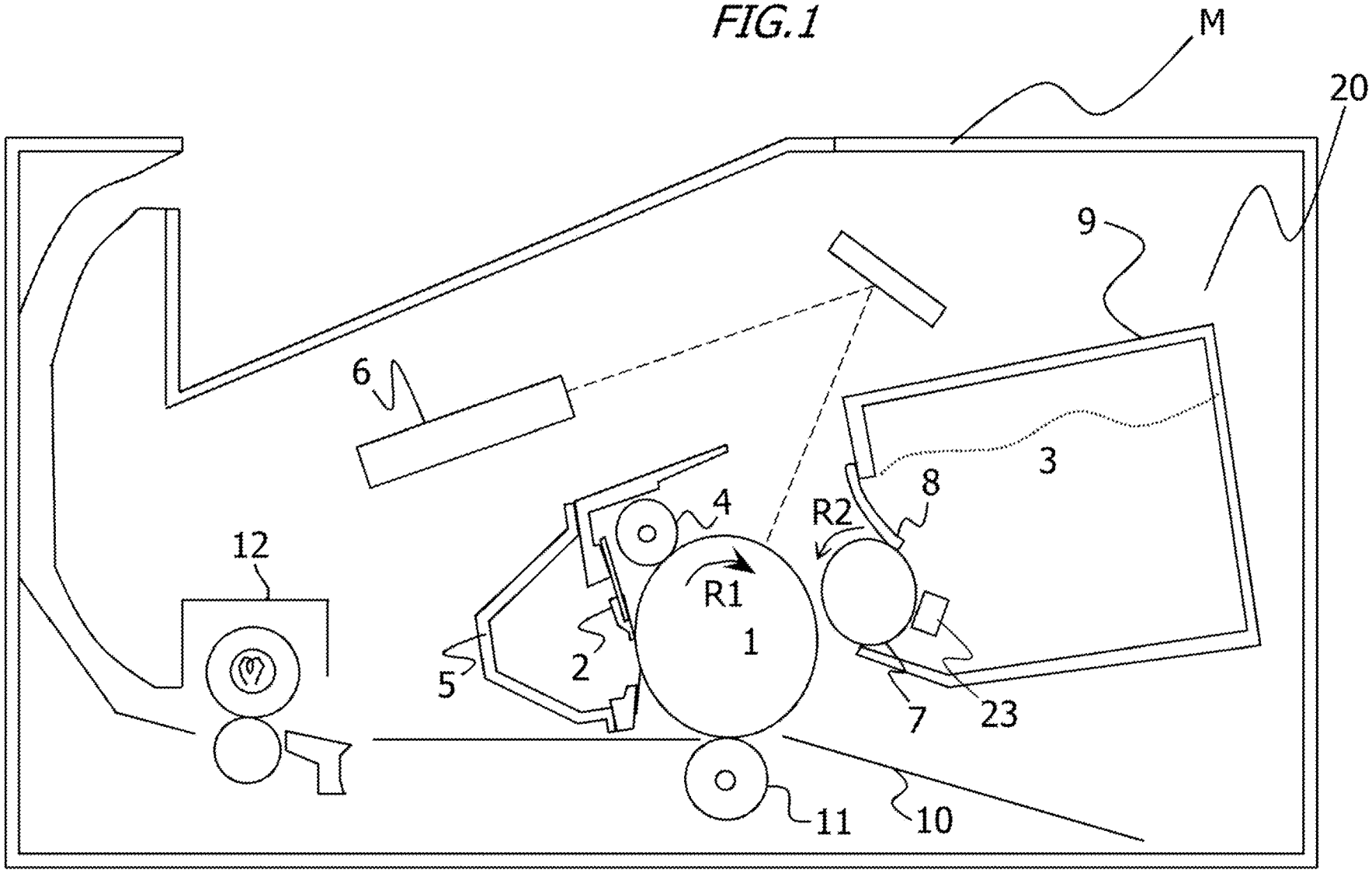
FIG. 1 is a cross-sectional diagram of an image forming apparatus according to a first embodiment.

FIG. 1 illustrates an example of an electrophotographic image forming apparatus according to the first embodiment. The image forming apparatus forms images on recording material. In an image forming apparatus main body M, a photosensitive drum (image bearing member) 1 is provided as a member to be charged. The photosensitive drum 1 is obtained by forming an organic photosemiconductor (OPC) photosensitive layer on the outer peripheral surface of a conductive drum, and when a driving command is transmitted from the image forming apparatus main body M, the photosensitive drum 1 is rotationally driven in an R1 direction at predetermined process speed. The surface of the photosensitive drum 1 is charged with predetermined polarity and potential by a charging roller 4 applied with a charging bias. The charged surface of the photosensitive drum 1 is scanned and exposed by a laser beam scanner 6 as exposure means, and an electrostatic latent image corresponding to intended image information is formed. A developer container 9 as a developing apparatus includes a developing roller 7 as a developer bearing member, a developing blade 8 as a restricting member, and a brush 23 as a moving member. The developing roller 7 is rotationally driven in an R2 direction when a driving command is transmitted from the image forming apparatus main body M, and predetermined charge amount and toner layer (magnetic chains) are formed on the developing roller 7. After magnetic toner is supplied from the developing roller 7 to the photosensitive drum 1, the magnetic toner is adhered to the photosensitive drum 1 due to an electric field of developing bias, and an electrostatic latent image is developed as a toner image (developer image). Specifically, when the magnetic toner is supplied from the developing roller 7, an electrostatic latent image formed on the surface of the photosensitive drum 1 is developed, and a toner image is formed on the surface of the photosensitive drum 1. The magnetic toner is a magnetic developer. The magnetic toner is hereinafter referred to as "toner 3".

Recording material (paper) 10 is fed by a paper feed roller, and a toner image is transferred onto the surface of the recording material 10 between the photosensitive drum 1 and the transfer roller 11 by transfer bias. In this manner, the transfer roller 11 transfers the toner image developed on the developing roller 7 onto the recording material 10. The transfer roller 11 is an example of a transfer unit. The recording material 10 having the toner image transferred thereon is separated from the surface of the photosensitive drum 1 and conveyed to a fixing unit 12, and is heated and pressurized such that the toner image is fixed. In the photosensitive drum 1 after the toner image is transferred, untransferred toner 3 remaining on the surface without being transferred to the recording material 10 is removed by a cleaning member 2 as cleaning means, and is stored in a cleaning container 5 as waste toner.

After that, the cleaned surface of the photosensitive drum 1 is charged and exposed again, and the developing roller 7 after development is supplied with toner 3 again from the developer container 9. After that, the transfer and fixation are performed on the recording material 10, and a cycle of a series of image formation is performed. In the image forming apparatus according to this embodiment, a process device including the photosensitive drum 1 the charging roller 4, the developer container 9, and the cleaning container 5 is integrally incorporated with a cartridge container. In this manner, a process cartridge 20 removably (removably replaceable) provided to the image forming apparatus main body M is formed.

Outline of Developing Apparatus Including Moving Member

In the developing apparatus in the first embodiment, the brush 23 as a moving member is newly brought into contact with the developing roller 7 in the vicinity of a magnetic pole position of a magnet roller (fixed magnet) 22. In this manner, the toner layer on the developing roller 7 is not stripped by the brush 23 during driving of the developing roller 7, but the brush 23 is caused to reach the lowermost layer toner of magnetic chains to roll or move the lowermost layer toner. The movement of the lowermost layer toner solves the problem of sticking of toner 3 having high charge amount.

Figure 2:
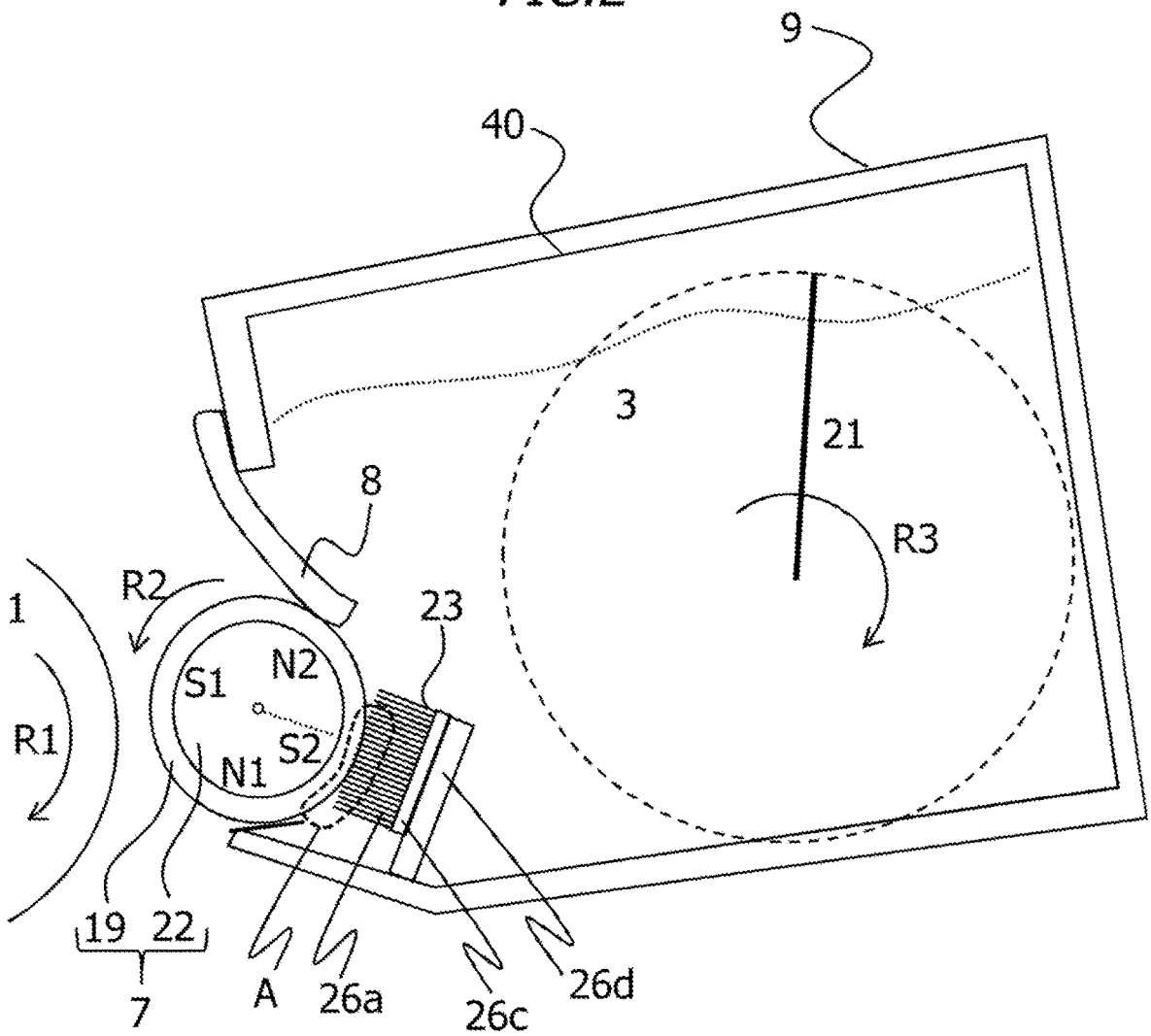
FIG. 2 is a cross-sectional diagram of a developing apparatus according to the first embodiment.

Next, the configuration of the developing apparatus including the moving member is described with reference to a cross-sectional view of the developing apparatus according to the first embodiment in FIG. 2. As illustrated in FIG. 2, the developer container 9 is provided with a toner storing chamber 40 for storing the toner 3 therein. The toner storing chamber 40 is an example of a developer storing chamber. The developing roller 7 is a rotatable developer bearing member that encloses the magnet roller 22 having a plurality of magnetic poles. The developing roller 7 has a developing sleeve 19 and the magnet roller 22. The developing sleeve 19 rotates in an R2 direction on an outer peripheral portion of the magnet roller 22. The magnet roller 22 is fixedly enclosed in the developing roller 7. The toner 3 is carried by the surface of the developing roller 7 (outer peripheral surface of developing sleeve 19) due to magnetic force of the magnet roller 22. The developing blade 8 restricts the layer thickness of the toner 3 on the developing roller 7. The brush 23 as a moving member is disposed with respect to the developing roller 7 such that the tip of the brush 23 is in contact with the surface of the developing roller 7 in the vicinity of the magnetic pole position of the magnet roller 22. The brush 23 is a fixed fur brush having ground fabric 26*c* in which a plurality of brush fibers 26*a* are transplanted. One end of the brush fiber 26*a* is fixed to a fixing end (ground fabric 26*c* and fixed plate 26*d* described later) of the moving member (brush 23), and the other end thereof is a free end. The brush 23 moves the toner 3 carried on the surface of the developing roller 7 before the toner 3 is restricted by the developing blade 8. The moved toner 3 is on the developer roller 7 after the brush 23 moved the toner 3 on the developer roller 7. A toner conveying member 21 is provided inside the toner storing chamber 40. When the toner conveying member 21 is rotationally driven in an R3 direction, the toner conveying member 21 conveys the toner 3 toward a direction in which the developing roller 7 and the brush 23 are disposed.

Main parameters in the first embodiment are listed below.

Developing Roller 7
Outer diameter: 18 mm
Material: metallic system (nickel/aluminum/SUS)
Surface roughness: Ra 0.2 to 1.0 μm
Number of rotations: 200 rpm
Spacing between photosensitive member and drum: 0.3 mm
Developing Blade 8
Material: urethan
Thickness: 1.0 mm
Toner 3
Material: styrene acrylic
Specific gravity: 1.6 g/cm$^3$
Weight-average particle diameter: 7 μm The weight-average particle diameter of the toner 3 is measured by a measuring apparatus. As the measuring apparatus, a precise particle counting and sizing apparatus "Coulter Counter Multisizer 3" (registered trademark, manufactured by Beckman Coulter, Inc.) using a hole electric resistance method provided with an aperture tube of 100 μm is used.

The magnetic pole positions of the magnet roller 22 mainly include the position of a development pole (S1 pole) and the position of a toner moving pole (S2 pole). The position of the development pole (S1 pole) of the magnet roller 22 is near a position at which the magnet roller 22 and the photosensitive drum 1 are opposed to each other. The position of the toner moving pole (S2 pole) of the magnet roller 22 is inside the developer container 9. The brush 23 in the first embodiment is in contact with near the position of the toner moving pole (S2 pole) on the upstream side in the rotation direction of the developing roller 7 restricted by the developing blade 8. In FIG. 2, when it is assumed that the vertically downward direction from the center of the magnet roller 22 is 0° and the angle increases from 0° in the counterclockwise direction, the position of the S2 pole in the first embodiment is 70°.

The brush 23 has a unit obtained by bonding ground fabric 26*c* transplanted with fibers (raised portions) of the brush 23 to a fixed plate 26*d*. In this manner, the brush fibers 26*a* of the brush 23 are fixed to the fixing end formed of the ground fabric 26*c* and the fixed plate 26*d*. The material of the brush 23 and the fixed plate 26*d* is conductive metal, and the brush 23 and the fixed plate 26*d* are electrically connected to each other at end portions. The brush 23 and the fixed plate 26*d* are also electrically connected to the developing roller 7, and the brush 23 and the developing roller 7 have the same potential. The fixed plate 26*d* is mounted to the developer container 9 such that the tip of the brush 23 is in contact with the surface of the developing roller 7 in the vicinity of the magnetic pole position of the magnet roller 22. As illustrated in FIG. 2, the brush 23 as a moving member is disposed at a position opposed to any of the magnetic pole positions among the plurality of magnetic poles of the magnet roller 22. For example, the contact position of the brush 23 with the developing roller 7 is opposed to any of the magnetic pole positions among the plurality of magnetic poles of the magnet roller 22.

In the first embodiment, conductive nylon fibers in which carbon powders are dispersed are used as conductive fibers serving as raised portion. As the fibers, fibers having a single fiber fineness of 2 to 15 dtex [dtex: indicating a mass (unit: grams) per single-fiber 10,000 meters], a diameter of 10 to 40 μm, and a dry strength of 1 to 3 cN/dtex is preferred. The preferable resistivity ρfiber of the fiber is 10 to $10^8$ Ωcm. The resistivity is measured by the following method. For example, 50 fibers are bundled into one, and a metal probe is brought into contact with the surface of the bundle with an interval of about 1 cm. A high resistance meter Advantest R8340A (manufactured by ADVANTEST CORPORATION) is used to actually measure a resistance value Rfiber under an applied voltage of 100 V to calculate the resistivity ρfiber.

The fiber length starting from a ground fabric portion of each fiber is 1 to 5 mm. The brush tip 26 of the brush fiber 26*a* is a free end, and in this example, the fiber length is set such that the inroad amount of a raised portion (brush fiber) to the outer peripheral surface of the developing roller 7 is 0.5 to 1.0 mm. The fiber material serving as the raised portion is not limited to nylon fiber as long as the material is conductive.

The configuration of the brush 23 and the entry amount in the developing roller 7 should be changed appropriately depending on an image forming apparatus to be used, and are not limited to the above-mentioned configuration and numerical values. In addition, the physical properties of the brush 23 include the fiber height, the fineness, the fiber density, and a weaving method, and any material can be used as long as the brush 23 does not strip the toner 3 on the developing roller by development driving but can move the toner lowermost layer.

Examples of parameters contributing to moving force include, in addition to the charge amount of the toner 3, the force (rotating speed) due to rotational motion of the developing roller, the magnetic force of the magnet roller 22, and physical properties of the brush 23 (pressing pressure of brush 23). Thus, the balance of the forces is important as a moving condition. In the first embodiment, the following Expression (1) is provided in order to clearly specify that the brush 23 as a moving member is disposed for the purpose of moving the lowermost layer toner rather than stripping a toner layer on the developing roller 7.

$$F\text{blade}/C\text{blade} < F\text{brush}/C\text{brush} \quad (1)$$

Fblade: magnetic attractive force of magnet roller at restricting position
Cblade: restricting force of blade at restricting position
Fbrush: magnetic attractive force of magnet roller at brush contact position
Cbrush: restricting force of brush at brush contact position The restricting position is a contact position of the developing blade 8 with the developing roller 7. The brush contact position is a contact position of the brush 23 with the developing roller 7. The left side in Expression (1) is "Fblade/Cblade (magnetic attractive force of magnet roller at restricting position/restricting force of blade at restricting position)". The left side in Expression (1) is obtained by dividing "Fblade", which attracts the toner layer on the developing roller 7 toward the developing roller 7, by "Cblade", which strips the toner layer on the developing roller 7 from the developing roller 7. The left side in Expression (1) is an index indicating how much the toner layer tends to remain at a restricting position (between developing roller 7 and developing blade 8) and how much the toner layer is less peeled off (stripped).

The right side in Expression (1) is "Fbrush/Cbrush (magnetic attractive force of magnet roller at brush contact position/restricting force of brush at brush contact position)". The right side in Expression (1) is an index indicating how much the toner layer tends to remain at the brush contact position (between developing roller 7 and brush 23) and how much the toner layer is less peeled off (stripped). Expression (1) indicates that "how much the toner layer is less stripped at the brush contact position" is larger than "how much the toner layer is less stripped at the restricting position". Expression (1) indicates that the toner layer is less stripped by the brush 23 at the brush contact position.

As specific values of "Cblade (restricting force of blade)" and "Cbrush (restricting force of brush)", "Pblade (linear pressure of blade)" and "Pbrush (linear pressure of brush)" can be used. The following Expression (2) may be used instead of Expression (1).

$$Fblade/Pblade < Fbrush/Pbrush \quad (2)$$

Pblade: linear pressure of blade at restricting position

Pbrush: linear pressure of brush at brush contact position

In the first embodiment, the blade linear pressure is set to 25 to 30 gf, the brush linear pressure is set to 15 to 20 gf, and the brush linear pressure is set to a value lower than that of the blade linear pressure. The linear pressure as used herein is force itself as understood from the unit "gf". A method of measuring the linear pressure is described. A contact pressure (blade linear pressure) of the developing blade 8 is a value determined by the following procedure. For example, three SUS sheets (thickness: 50 μm, width: w [cm]) are inserted between the contact nip between the developing roller 7 and the developing blade 8 without toner, and a spring pressure F [gf] obtained when the middle SUS sheet is pulled out is measured. A friction coefficient μ between the SUS sheets is measured. Then, contact pressure (linear pressure) P=μf/w is measured. The contact pressure (brush linear pressure) of the brush 23 is also a value determined by the same procedure. For example, the brush 23 is caused to enter the developing roller 7 by 1 mm without toner, and the above-mentioned three SUS sheets are inserted between contact nips.

The purpose of the brush 23 used in the first embodiment is to move the toner layer on the developing roller 7, not to strip the toner layer on the developing roller 7. Thus, the brush 23 in which the density of hair of the brush 23 (brush fibers) is "sparse" with respect to the density of magnetic chains is used. For example, it is considered that when the density of hair of the brush 23 is "dense" with respect to the density of magnetic chains, the effect of stripping a toner layer on the surface of the developing roller increases. In such a case, the brush restricting force is considered to be substantially the same as the blade restricting force. However, in such a situation, excessive load is applied to the toner 3, which is not preferred in terms of degradation of the toner 3. In other words, the conditional expressions of Expression (1) and Expression (2) are on the assumption that the density of hair (brush fibers) of the brush 23 as a moving member is sparse. The sparse state is achieved by the brush 23 as a moving member which has a plurality of brush fibers and in which one end of each brush fiber is fixed to a fixing end including ground fabric 26*c* and the other end thereof is a free end, and magnetic chains 25 as a toner layer described later.

In the state in which the brush 23 is brand-new with no attachment on its surface, the influence of stripping may become larger than that of movement. However, the brush 23 immediately becomes a steady state and the influence of movement becomes larger than that of stripping, and hence descriptions of minor stripping in the brand-new state are herein omitted.

Movement of Magnetic Chains

Next, a mechanism for moving magnetic chains in this embodiment is described. Prior to the description, a configuration in a comparative example in which <1> the tip of the brush 23 cannot come into contact with the surface of the developing roller 7 and <2> the movement of magnetic chains does not occur is described.

Figure 8:
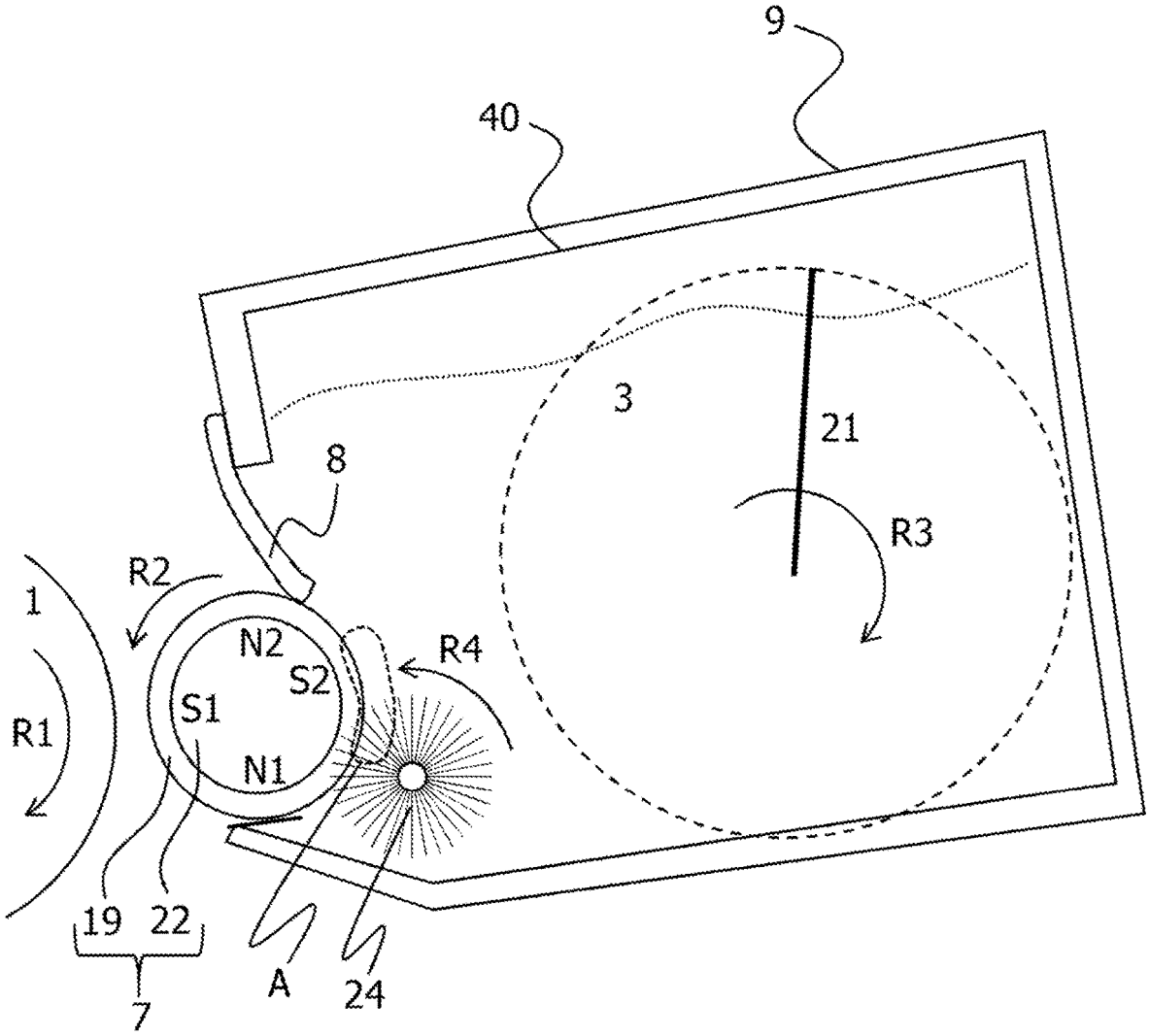
FIG. 8 is a cross-sectional diagram of a developing apparatus according to a comparative example.
Figure 9:
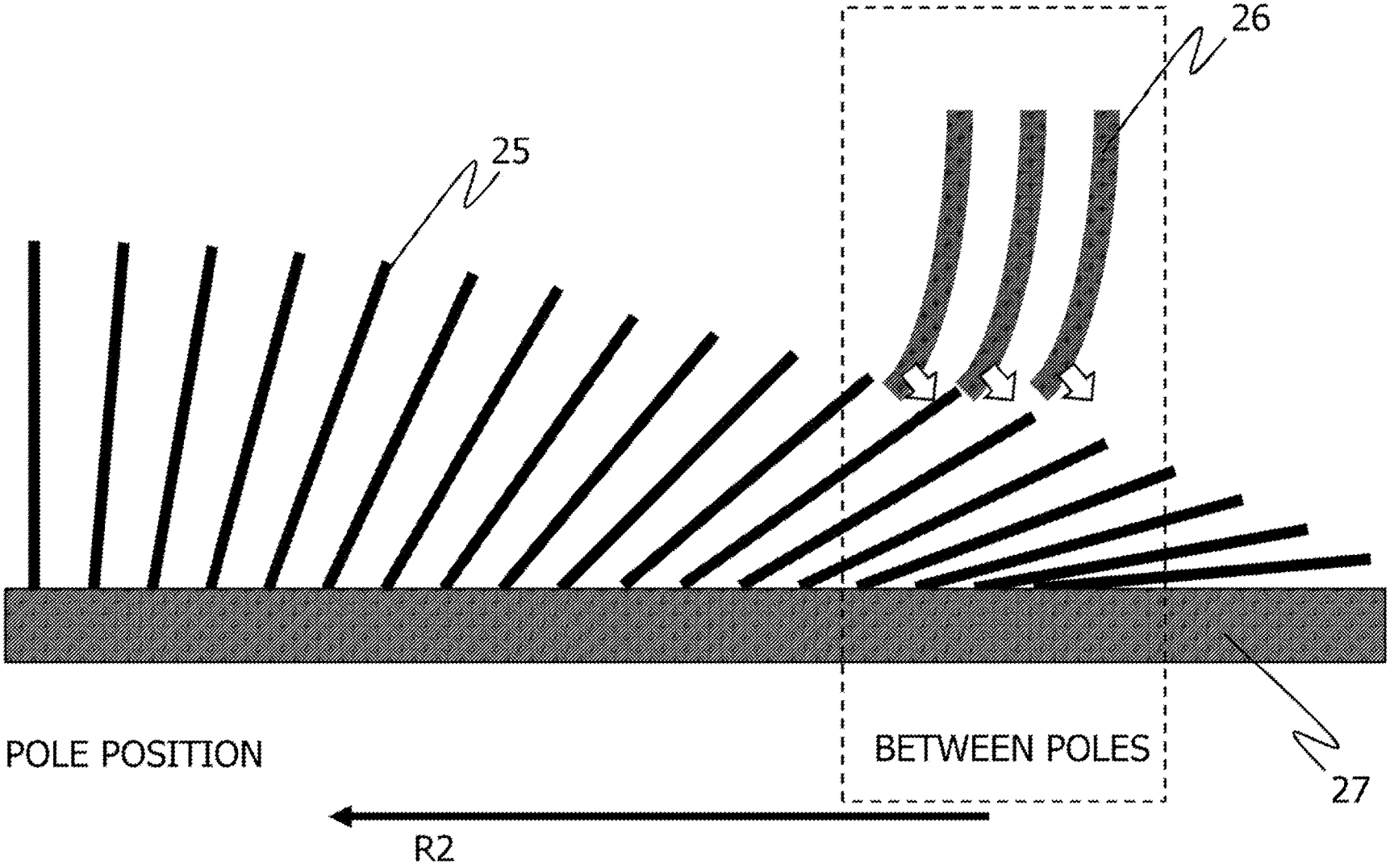
FIG. 9 is a relationship diagram of a brush in the developing apparatus and magnetic chains according to the comparative example.

The configuration in the comparative example in which <1> the tip of the brush 23 cannot come into contact with the surface of the developing roller 7 is described with reference to FIG. 8 and FIG. 9. FIG. 8 is a cross-sectional diagram of a developing apparatus according to the comparative example. As illustrated in FIG. 8, a contact position between the developing roller 7 and the brush 23 is near a position between poles of the magnet roller 22. FIG. 9 is a relationship diagram of the brush 23 and the magnetic chains 25 in the developing apparatus according to the comparative example, illustrating the state of the magnetic chains 25 near a contact position (broken line portion A) between the developing roller 7 and the brush 23 in FIG. 8. When the magnetic chains 25 as a toner layer are located near the position between poles of the magnet roller 22, the magnetic chains 25 are present while being inclined along a magnetic field (magnetic line) of the magnet roller 22 (part surrounded by broken line in FIG. 9).

Figure 10A:
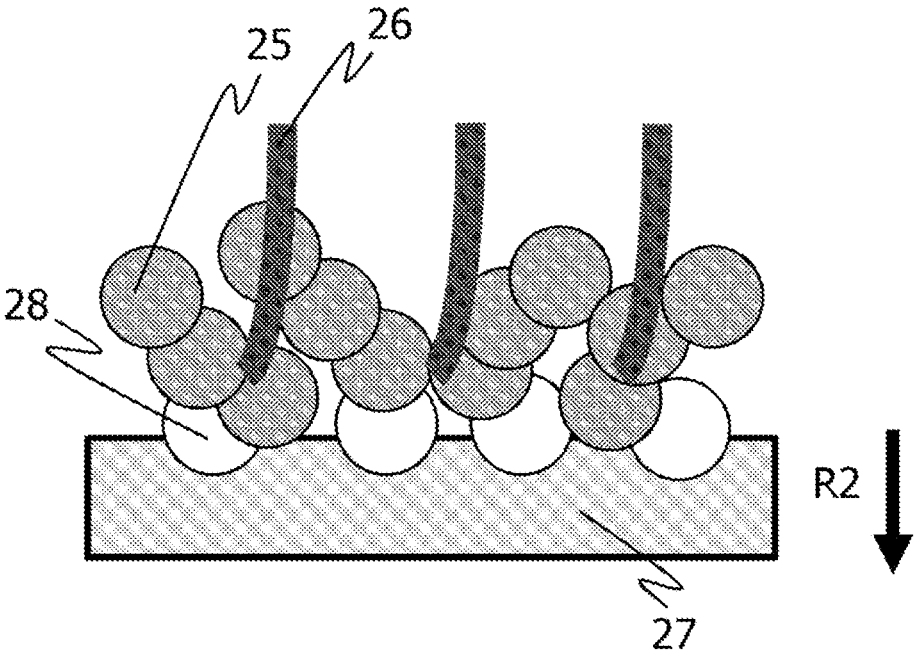
FIGS. 10A and 10B are diagrams illustrating magnetic chains between magnetic poles in the configuration of the comparative example.
Figure 10B:
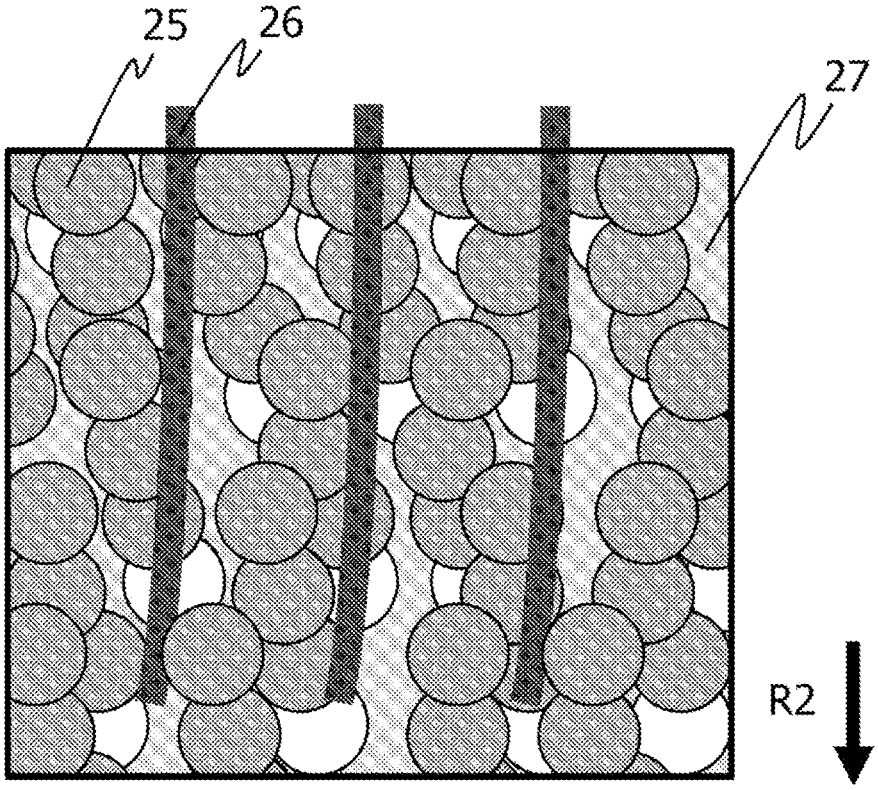

FIG. 10A is a diagram of magnetic chains 25 between magnetic poles in the configuration in the comparative example as seen from the side of the developing roller 7. FIG. 10B is a diagram of magnetic chains 25 at a magnetic pole position in the comparative example as seen from above the surface of the developing roller 7. On the surface of the developing roller 7, the magnetic chains 25 between magnetic poles described above are dense when seen from the above. In other words, the gap among the magnetic chains 25 is narrow (developing roller surface 27 is not seen through). Thus, the brush tip 26 cannot enter the lower side of the magnetic chains 25 and cannot come into contact with the developing roller surface 27 on the lower side of the toner layer.

Figure 11A:
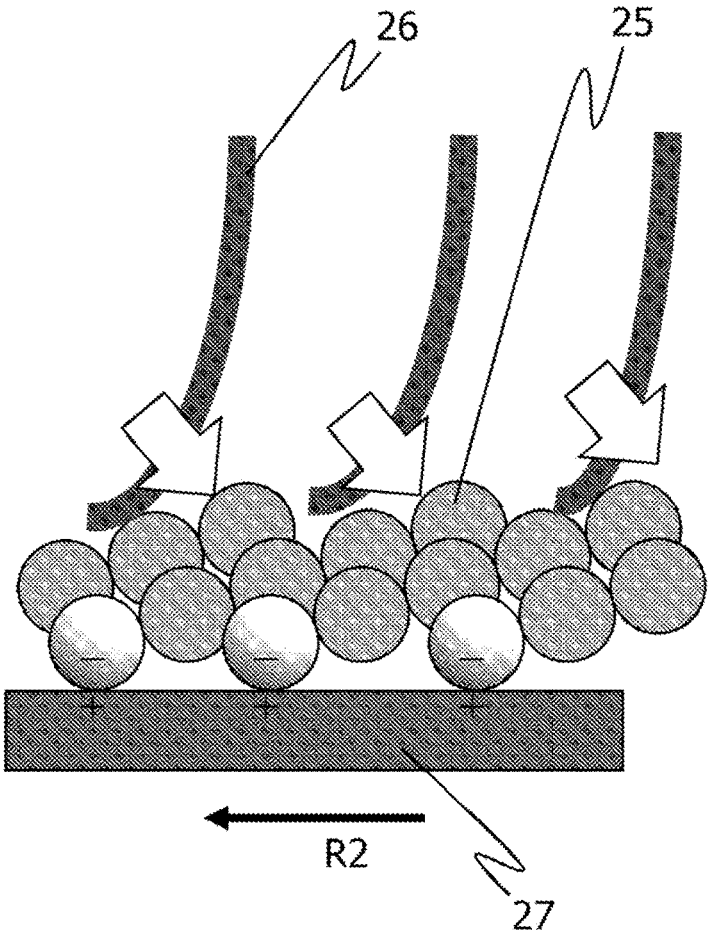
FIGS. 11A and 11B are relationship diagrams of the brush in the developing apparatus and magnetic chains according to the comparative example.
Figure 11B:
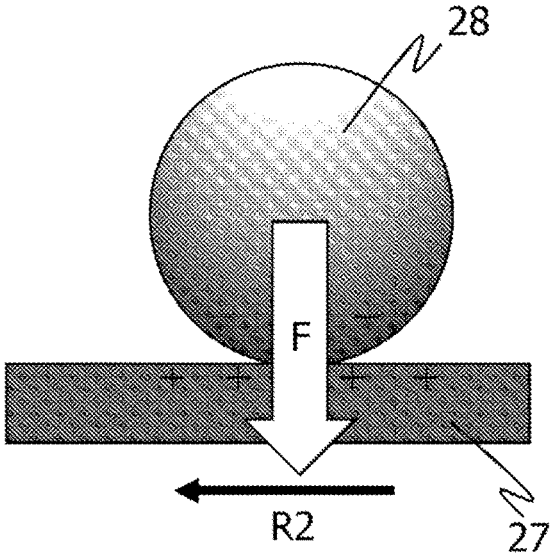

Next, the configuration in the comparative example in which <2> the movement of magnetic chains does not occur is described with reference to an enlarged diagram of magnetic chains 25 in FIG. HA and an enlarged diagram of a lowermost layer toner 28 in FIG. 11B. In the state in which the toner 3 on the developing roller 7 is inclined as magnetic chains 25 between magnetic poles, the brush tip 26 cannot come into contact with the developing roller surface 27 and the lowermost layer toner 28 of the magnetic chains 25. In such a state, even when the developing roller 7 is driven in the developing roller rotation direction R2, a force of moving the lowermost layer toner 28 of the magnetic chains 25 does not act, and the lowermost layer toner 28 in the magnetic chains 25 cannot be moved. As a result, the lowermost layer toner 28 of the magnetic chains 25 cannot be moved by the brush 23, and the force by which the lowermost layer toner 28 adheres to the developing roller surface 27 (reflection force, arrow F) cannot be weakened. In other words, the toner 3 having high charge amount easily sticks to the surface of the developing roller 7 due to an increased electrostatic attachment force. The toner 3 having high charge amount on the developing roller surface 27 more attracts the toner 3 having low charge amount, and it is more difficult to restrict the toner 3 by the developing blade 8 and a restrict failure more easily occurs.

Next, the configuration in the first embodiment in which <3> the brush tip 26 can come into contact with the surface of the developing roller 7 and <4> the movement of magnetic chains 25 occurs is described.

Figure 3:
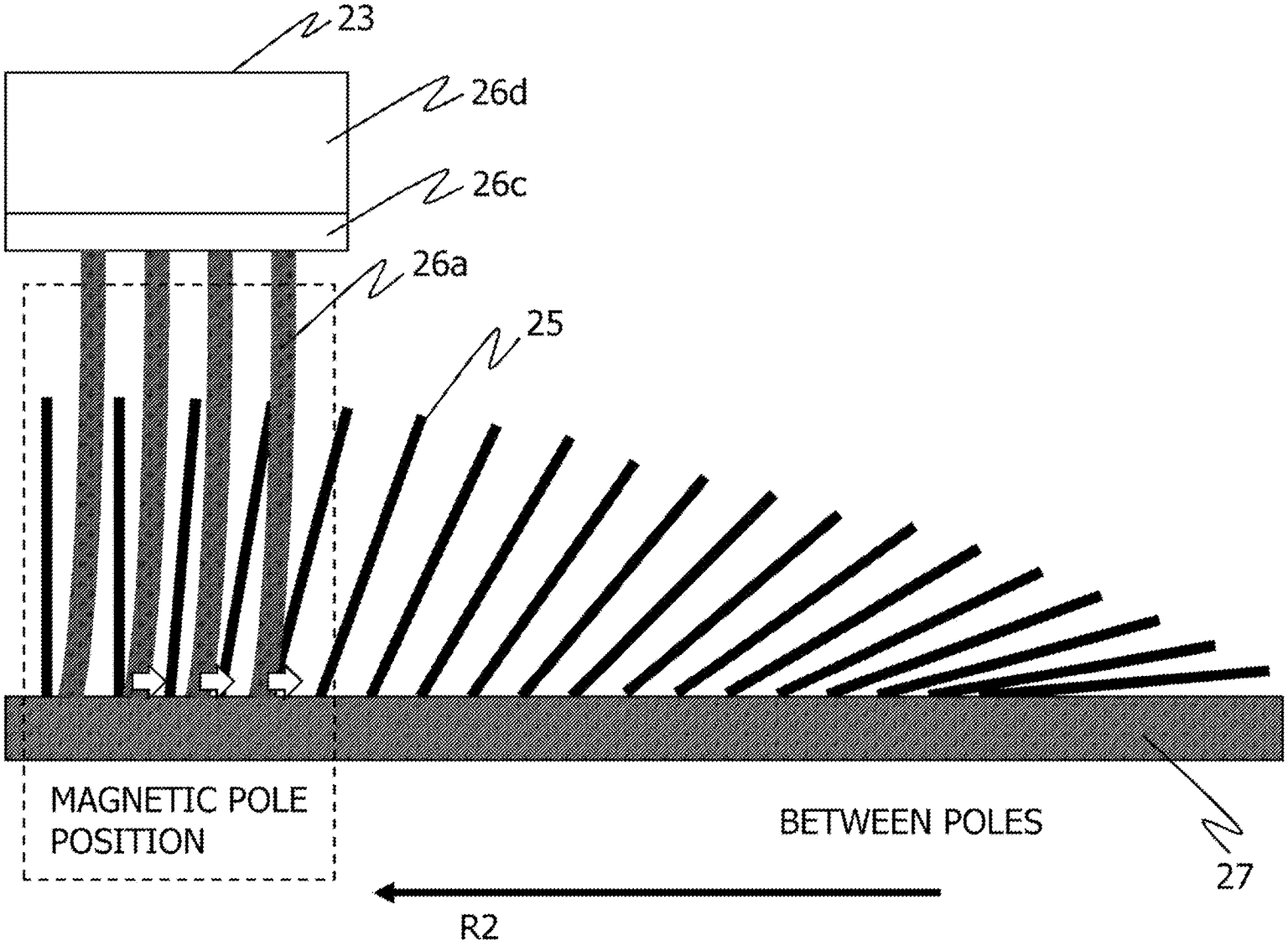
FIG. 3 is a relationship diagram of a brush in the developing apparatus and magnetic chains according to the first embodiment.
Figure 4A:
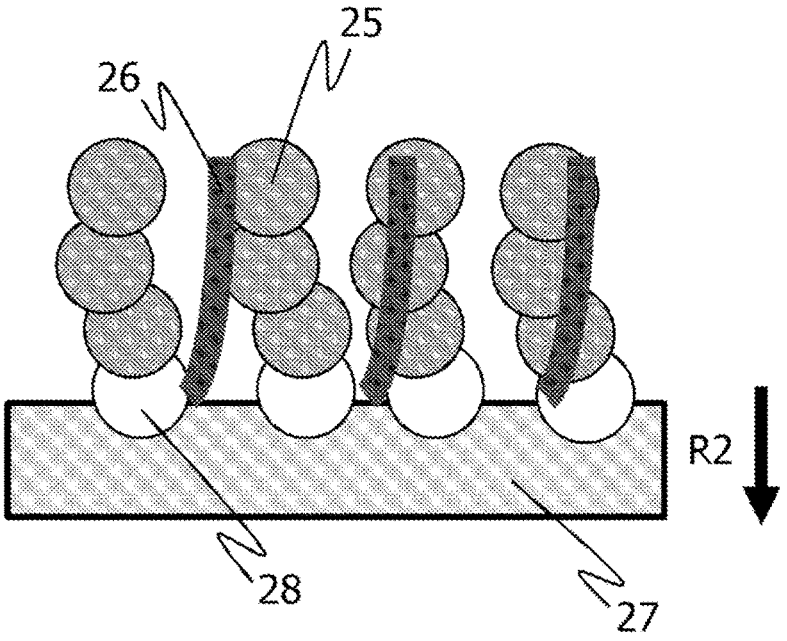
FIGS. 4A and 4B are diagrams illustrating magnetic chains at a magnetic pole position in the configuration of the first embodiment.
Figure 4B:
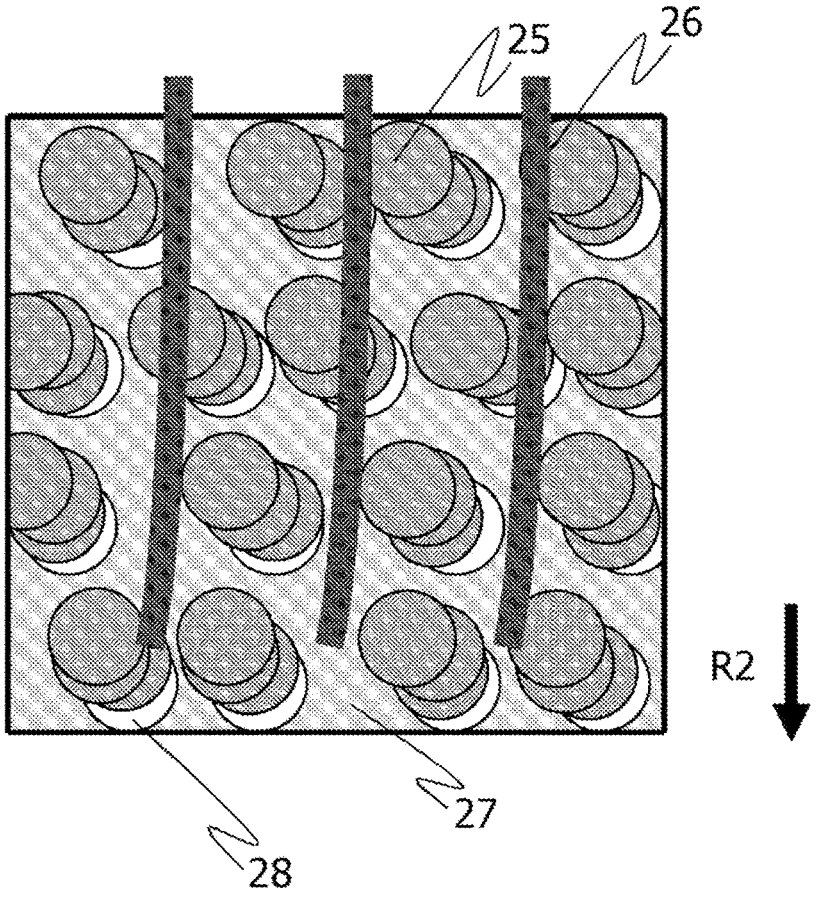

First, the configuration in the first embodiment in which <3> the brush tip 26 can come into contact with the surface of the developing roller 7 is described with reference to FIG. 3. FIG. 3 is a relationship diagram of the brush 23 and the magnetic chains 25 in the developing apparatus in the first embodiment, illustrating the state of magnetic chains 25 near a contact position (broken line portion A) between the developing roller 7 and the brush 23 in FIG. 2. When the magnetic chains 25 as a toner layer are located near a magnetic pole position of the magnet roller 22, the toner 3 is concentrated along a magnetic field (magnetic line) of the magnet roller 22. Thus, the magnetic chains 25 in the state in which the toner 3 is upright in the form of chains from the developing roller surface 27 are formed (part surrounded by broken line in FIG. 3). FIG. 4A is a diagram of magnetic chains 25 at the magnetic pole position in the configuration in the first embodiment as seen from the side of the developing roller 7. FIG. 4B is a diagram of magnetic chains 25 at the magnetic pole position in the configuration in the first embodiment as seen from above the surface of the developing roller 7. The gap among the magnetic chains 25 at the magnetic pole position described above is long when seen from above the surface of the developing roller 7. In other words, the gap among the magnetic chains 25 is wide (developing roller surface 27 is seen), and hence the brush tip 26 can enter the lower side of the magnetic chains 25 to come into contact with the lower side of the toner layer.

Figure 5A:
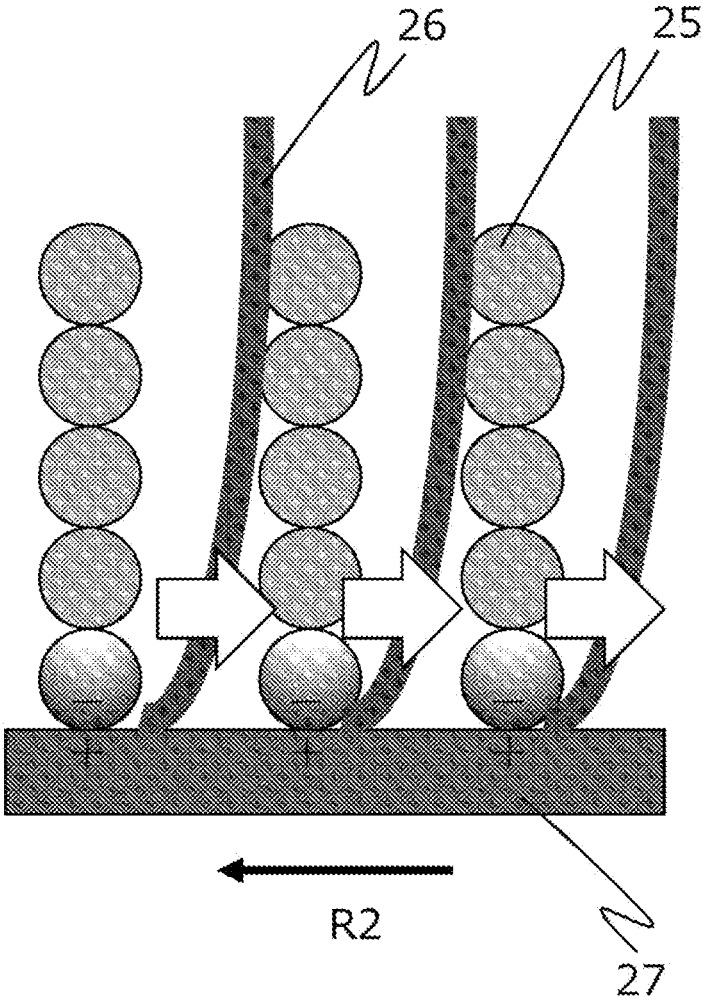
FIG. 5A is a relationship diagram of the brush in the developing apparatus and magnetic chains according to the first embodiment.
Figure 5B:
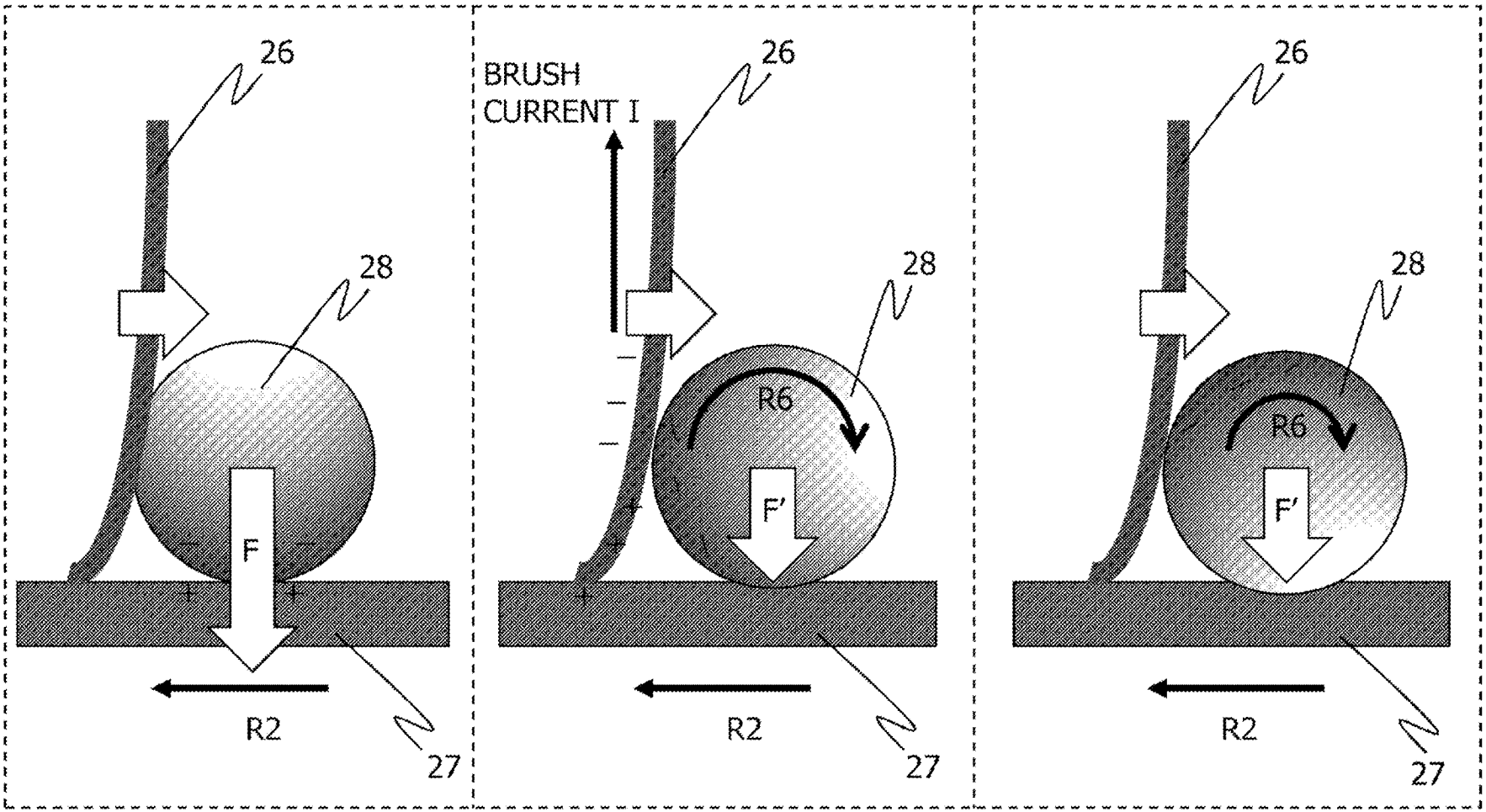
FIG. 5B is a relationship diagram of the brush in the developing apparatus and magnetic chains according to the first embodiment.

Next, the configuration in the first embodiment in which <4> the movement of magnetic chains 25 occurs is described with reference to an enlarged diagram of magnetic chains 25 illustrated in FIG. 5A and an enlarged diagram of a lowermost layer toner 28 illustrated in FIG. 5B. In the state in which the toner 3 on the developing roller 7 rises as magnetic chains 25 at a magnetic pole position, the brush tip 26 can come into contact with the developing roller surface 27 and the lowermost layer toner 28 of the magnetic chains 25. When the developing roller 7 is driven for development (developing roller rotation direction R2) in the state in which the brush tip 26 is in contact with the lowermost layer toner 28 of the magnetic chains 25, a force (R6) of moving the lowermost layer toner 28 of the magnetic chain 25 acts on the brush tip 26 due to the rotational driving force of the developing roller 7. In this manner, the lowermost layer toner 28 of the magnetic chains 25 can be moved (rolled) to weaken the force by which the lowermost layer toner 28 adheres to the developing roller surface 27.

When the lowermost layer toner 28 of the magnetic chains 25 is moved by the brush 23, charge-transfer occurs in the brush 23. Subsequently, the configuration in the first embodiment in which <5> charge-transfer occurs in the toner 3 and the brush 23 is described with reference to an enlarged diagram of the lowermost layer toner 28 illustrated in FIG. 5B. The lowermost layer toner 28 has negative charge on its toner surface layer, and strongly adheres to the developing roller surface 27 (reflection force F). On the other hand, the developing roller surface 27 has positive charge corresponding to the negative charge of the toner surface layer. When the brush tip 26 rolls the lowermost layer toner 28 in the R6 direction, the negative charge of the toner surface layer is separated from the developing roller surface 27. As a result, a force (reflection force F') by which the lowermost layer toner 28 adheres to the developing roller surface 27 is weakened.

On the other hand, the brush tip 26 comes into contact with positive charge of the developing roller surface 27 separated from the negative charge of the toner surface layer. At the brush tip 26 which is in contact with the positive charge of the developing roller surface 27, the negative charge starts to transfer toward the brush tip 26 so as to correspond to the positive charge. As a result, the negative charge transfers in the brush 23, and a brush current I can be detected. A method of detecting the brush current I and detection results thereof are described later.

When the toner 3 having high charge amount, which is more liable to stick to the developing roller surface 27, sticks directly to the developing roller surface 27, the toner 3 acts so as not to be charged at a predetermined level or more. In the first embodiment, the lowermost layer toner 28 is moved by the brush 23. In this manner, the lowermost layer toner 28 having high charge amount and upper layer toner having low charge amount in the toner layers on the developing roller 7 are mixed together, so that the toner layers on the developing roller 7 can be uniformly charged. In the first embodiment, the brush 23 can be referred to as "charge-transfer promoting means" because the brush 23 promotes the charge-transfer in the lowermost layer toner 28 and promotes the uniform charging of the toner layers on the developing roller 7.

The movement of the toner 3 of the magnetic chains 25 described above includes the case where the toner 3 itself rolls without changing the position of the toner 3 in the magnetic chains 25 and the case where the toner 3 moves from a lower layer to an upper layer in the magnetic chains 25. The movement of the toner 3 of the magnetic chains 25 also includes the case where the toner 3 moves to peripheral magnetic chains 25 and the case where the moved toner 3 forms magnetic chains 25 again.

Method of Verifying Movement

Next, a method of verifying that the lowermost layer toner 28 of the magnetic chains 25 is moved by the brush 23 which is in contact with the lowermost layer toner 28 is described. As described above, when the lowermost layer toner 28 is moved and the brush tip 26 comes into contact with the positively-charged developing roller surface 27, negative charge-transfer occurs in the brush 23. Thus, a detectable brush current I is generated by moving the lowermost layer toner 28. In other words, the detection of the brush current I verifies that the lowermost layer toner 28 of the magnetic chains 25 has been successfully moved.

On the other hand, in the case of the stripping in the conventional technology, the brush current I may flow similarly to the movement in the first embodiment. However, in the case of the stripping in the conventional technology, a fogging image is generated due to insufficient charging of the toner 3, and hence whether the movement has been effectively performed can be easily checked by checking both the brush current I and the fogging image. Here, the brush current I is detected in the state in which no fogging image is generated.

Figure 6:
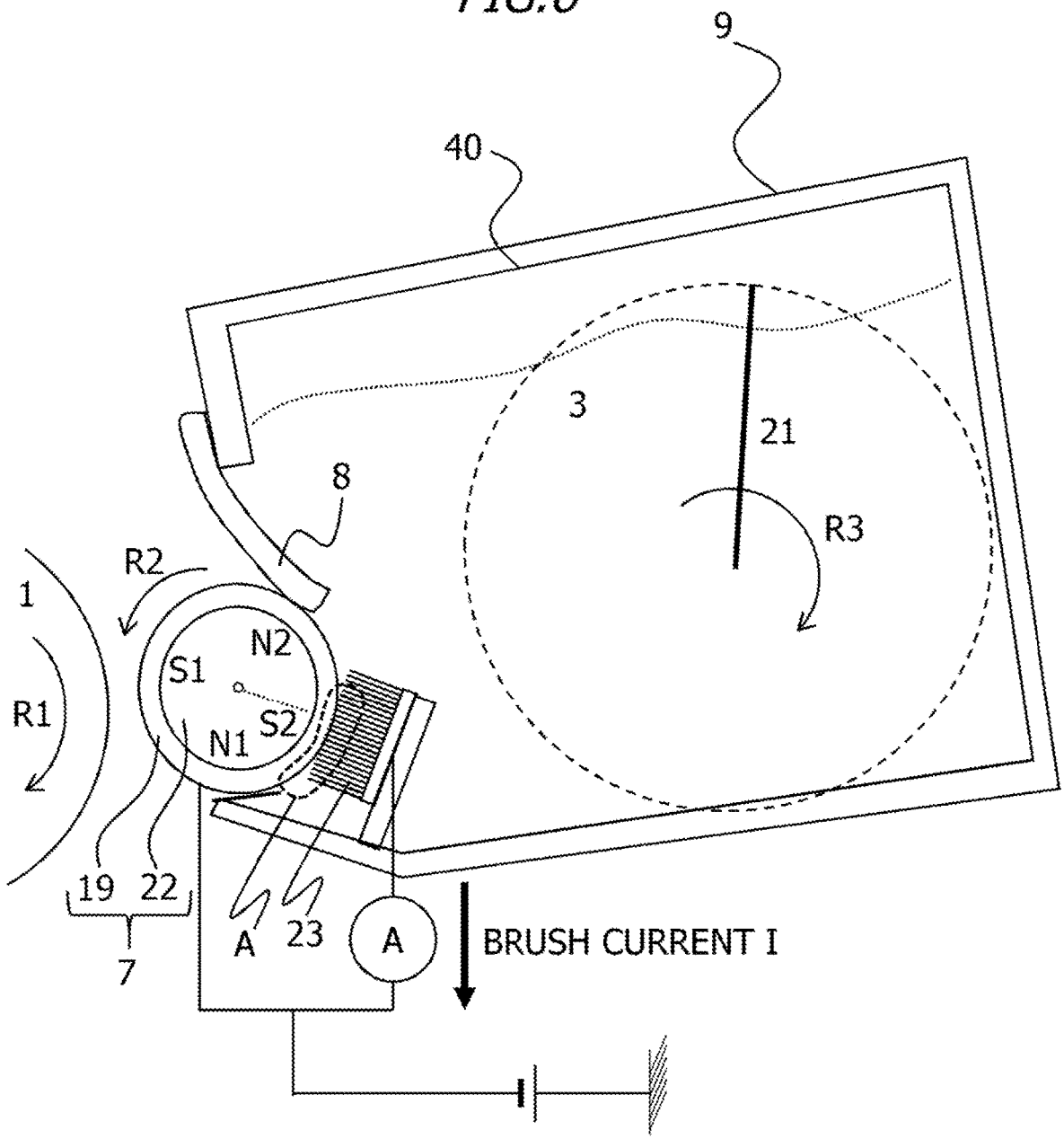
FIG. 6 is a cross-sectional diagram of a developing apparatus having brush current detection means in the first embodiment.

FIG. 6 is a cross-sectional diagram of the developing apparatus having brush current detection means. As the brush current detection means, a current detection circuit is disposed on a brush voltage application side of a high voltage applying means for setting the developing roller 7 and the brush to have the same potential, so that the brush current I is detected.

Figure 7A:
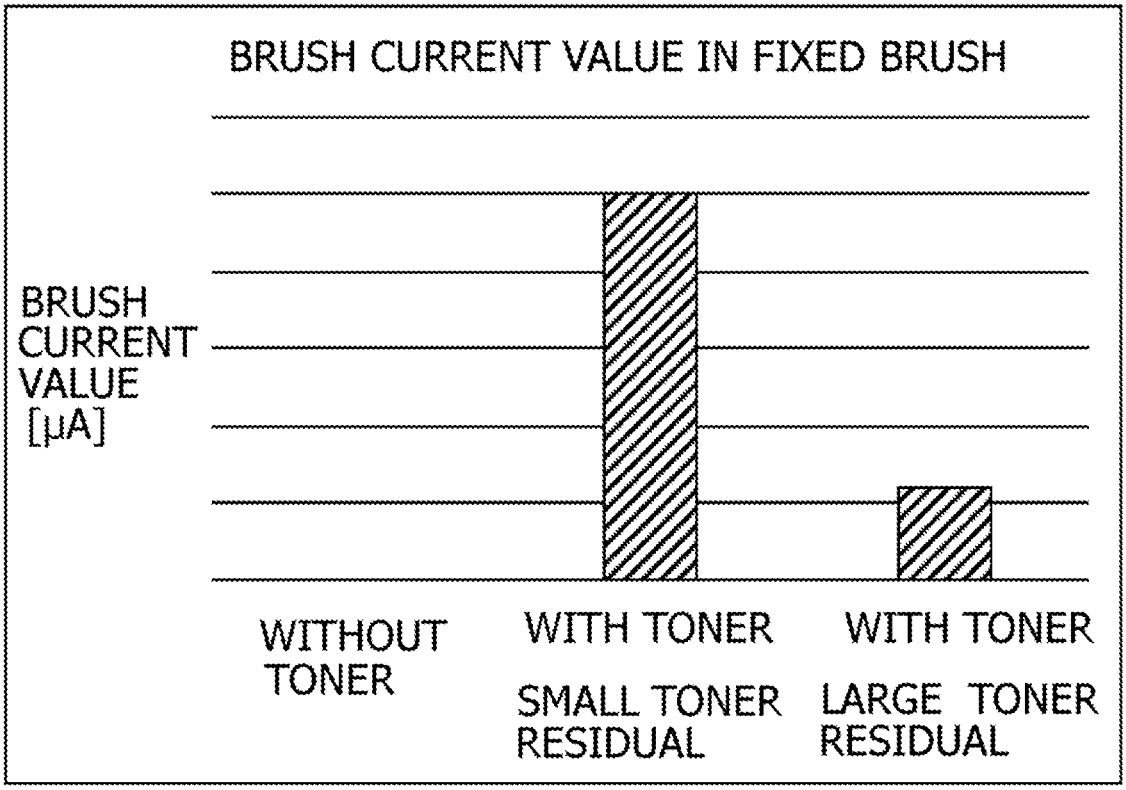
FIGS. 7A and 7B are diagrams illustrating results of brush current in the first embodiment.
Figure 7B:
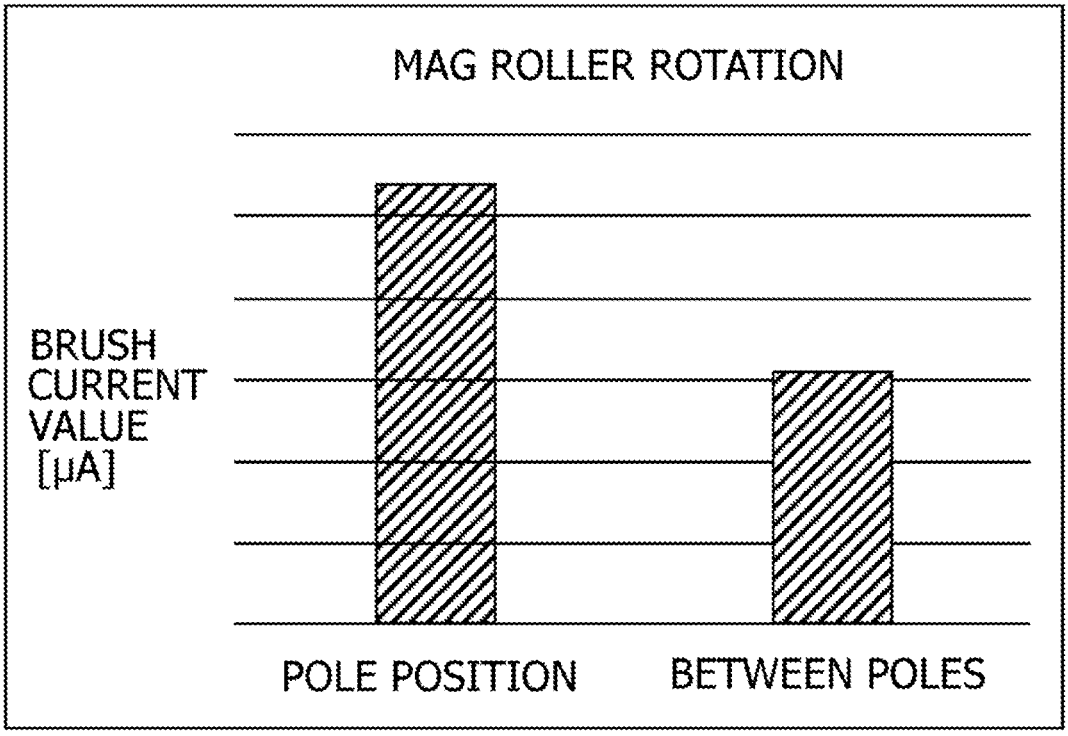

FIG. 7A and FIG. 7B illustrate results of the brush current obtained by the brush current detection means. FIG. 7A illustrates a measurement result of the brush current I when the toner 3 is located near a contact nip between the developing roller 7 and the brush tip 26 and when the toner 3 is not located near the contact nip. FIG. 7B illustrates a measurement result of the brush current I at a magnetic pole position of the magnet roller 22.

As indicated by the measurement result A of the brush current I in FIG. 7A, when the toner 3 is absent, no brush current I flowed even if the brush and the developing roller 7 are brought into contact with each other (0 μA). This result indicates that when the toner 3 is not moved, the charge-transfer or the brush current I does not occur. Next, as indicated by the measurement result A of the brush current I in FIG. 7A, when much toner 3 remained near the contact nip between the developing roller 7 and the brush tip 26 in the state "with toner", the brush current I slightly flowed (0.05 μA). This result indicates that the toner 3 is slightly moved and the charge-transfer occurs. When an image is actually output, a slight restriction failure occurs (Δ). When the amount of toner residual near the contact nip between the developing roller 7 and the brush tip 26 is small in the state "with toner", a large brush current I flowed (0.25 μA). This result indicates that the toner 3 is more greatly moved and the charge-transfer occurs greatly. When an image is actually output, no restriction failure occurred (O).

As indicated by the measurement result B of the brush current I in FIG. 7B, when the S2 pole is shifted by 30 degrees on the downstream side in the rotation direction of the developing roller 7 and the brush 23 is disposed between the N1 pole and the S2 pole (between poles), a slight brush current I flowed (0.05 μA). This result indicates that the toner 3 is slightly moved and the charge-transfer occurs. When an image si actually output, a slight restriction failure occurs (Δ). On the other hand, when the brush 23 is disposed at the S2 pole (pole position), a large brush current I flowed (0.25 μA). This result indicates that the toner 3 is more effectively moved and the charge-transfer occurs more greatly when the brush 23 is disposed at the pole position. When an image is actually output, no restriction failure occurs (O).

In the first embodiment in which the movement state can be detected by such a brush current detection circuit, the movement conditions are determined depending on the purposes such as required image quality and the durable number of sheets. The reason is that the movement conditions relate to the prevention of sticking of highly-charged toner 3 to the developing roller surface 27 and local unevenness of charge amount, and an effect for high image quality can be obtained.

Comparison Results

The following Table 1 indicates a comparison between the first embodiment and a conventional example.

TABLE 1

| | Conventional example | First embodiment Fixed brush |
|---|---|---|
| Toner sticking (restriction failure) | Very good | Good |
| Toner stripped (fogging) | Bad | Good |
| Load on toner (density decrease) | Bad | Ordinary |

In the conventional example, the brush having high strippability is brought into contact with a portion between poles of the magnet roller 22 so that the toner 3 having charge amount near the developing roller 7 is easily stripped to improve a restriction failure. As a result, the charge amount of the toner 3 before restricted by the blade after a stripping process becomes insufficient to cause fogging. The brush having high strippability mechanically rubs the toner 3, and hence the toner 3 degrades and fogging and density decrease occur.

In the first embodiment, on the other hand, the brush 23 as a moving member is brought into contact with the pole position of the magnet roller 22 such that the toner 3 having high charge amount on the developing roller surface 27 can be moved. In this manner, a restriction failure in which the lowermost layer toner 28 sticks to the developing roller surface 27 with a high reflection force so that it is difficult to restrict the lowermost layer toner 28 by the developing blade 8 can be improved.

Particularly in electrophotographic image formation using mono-component magnetic toner (developer), the problems of fogging and density decrease conspicuously arise due to toner deterioration (charge amount decrease), but the first embodiment can solve or reduce the problems. Specifically, the brush 23 in the first embodiment can suppress the influence of stripping of the toner 3 as compared with the brush described in the conventional example, thereby maintaining and uniformizing the charge amount of the toner 3 after the stripping process and before the blade restriction and improving the fogging. In addition, the brush 23 in the first embodiment does not mechanically rub the toner 3 unlike a brush having high strippability, and hence the degradation of the toner 3 can be suppressed to suppress fogging and density decrease. In other words, the toner 3 of the coat layer can be moved by the brush 23 to prevent the toner 3 having high charge amount from sticking to the developing roller surface, and also the charging of the toner 3 can be maintained and made uniform. Thus, the first embodiment is superior to the conventional example.

Second Embodiment

Outline of the Second Embodiment

The second embodiment is different from the first embodiment in that the moving member is not fixed but has a roller shape and the moving member is in contact with the developing roller 7 in opposite directions (counter contact). The conditions such as the brush fiber (raised portion) and the conditions of Expression (1) and Expression (2) are the same as in the first embodiment, and hence detailed descriptions thereof are omitted. The configuration in the second embodiment can prevent a decrease in the moving effect even in the state in which the toner 3 easily remains in the moving member due to an increase in cohesion degree of the toner 3 caused by degradation of the toner 3 or environmental fluctuations. Thus, the second embodiment is preferred as a configuration for maintaining the moving effect for a long period of time.

Configuration in the Second Embodiment

Figure 12A:
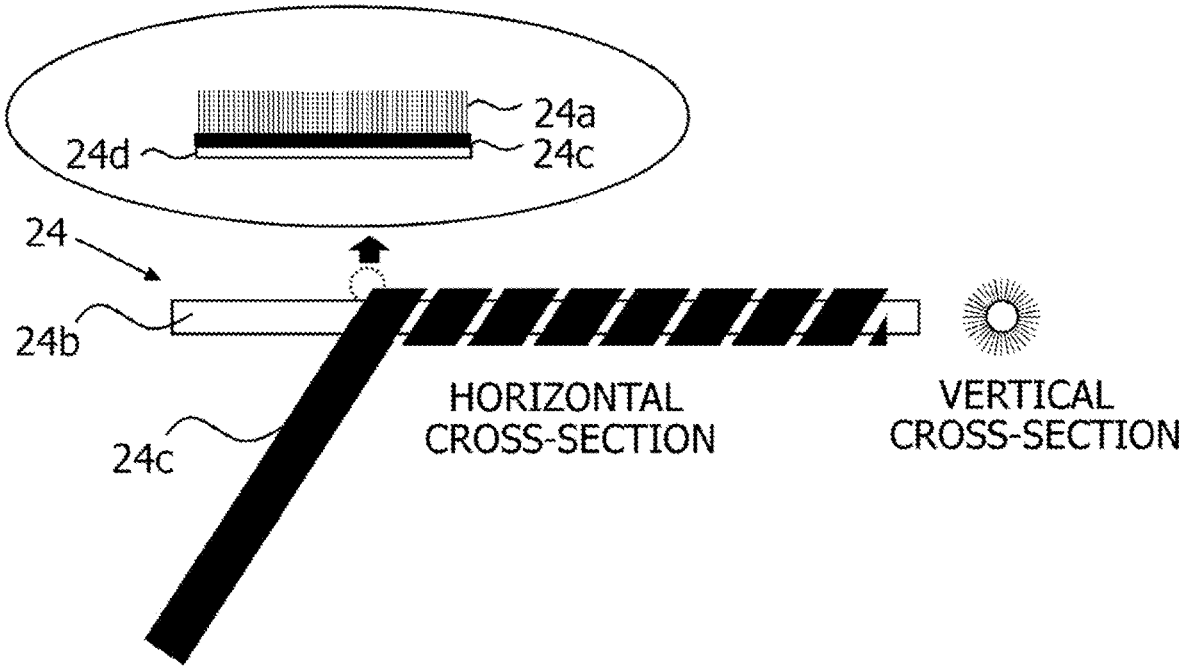
FIGS. 12A and 12B are explanatory diagrams of a moving member in a second embodiment.
Figure 12B:
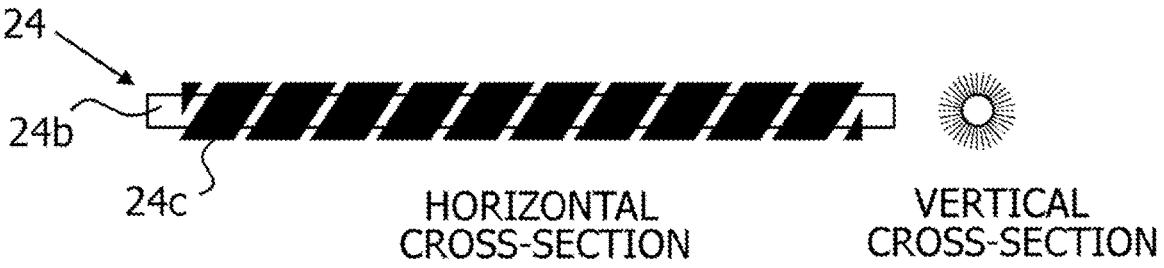

A configuration of a moving member in the second embodiment is described. As illustrated in FIGS. 12A and 12B, the moving member in the second embodiment is a brush roller 24 having a unit configuration in which a ground fabric 24*c* transplanted with a plurality of brush fibers 24*a* is provided, double-sided tape 24*d* is bonded to the bottom surface of the ground fabric 24*c*, and the resultant is spirally wound around a core 24*b* to have a roller shape. The core 24*b* is a columnar rotating shaft, and the diameter thereof is 5 mm. The brush roller 24 is a fur brush in which the brush fibers 24*a* are provided on the peripheral surface of the rotating shaft. FIG. 12A illustrates the state in which the ground fabric 24*c* is being wound around the core 24*b*. FIG. 12A illustrates the state after the ground fabric 24*c* is wound around the core 24*b*. One end of the brush fiber 24*a* is fixed to the fixing end and the other end thereof is a free end similarly to the first embodiment.

The material of the brush roller 24 is conductive, and the fiber height, the fineness, the fiber density, and a weaving method as physical properties of the brush may have any value similarly to the first embodiment as long as the brush roller 24 has a roller shape and is capable of moving the toner. The material of the core 24*b* is SUS, which is conductive. The core 24*b* is conductive to the brush fibers 24*a* at end portions thereof. The core 24*b* is also connected to the developing roller 7 through an electric circuit, and hence the brush fibers 24*a* and the developing roller 7 have the same potential.

Figure 13:
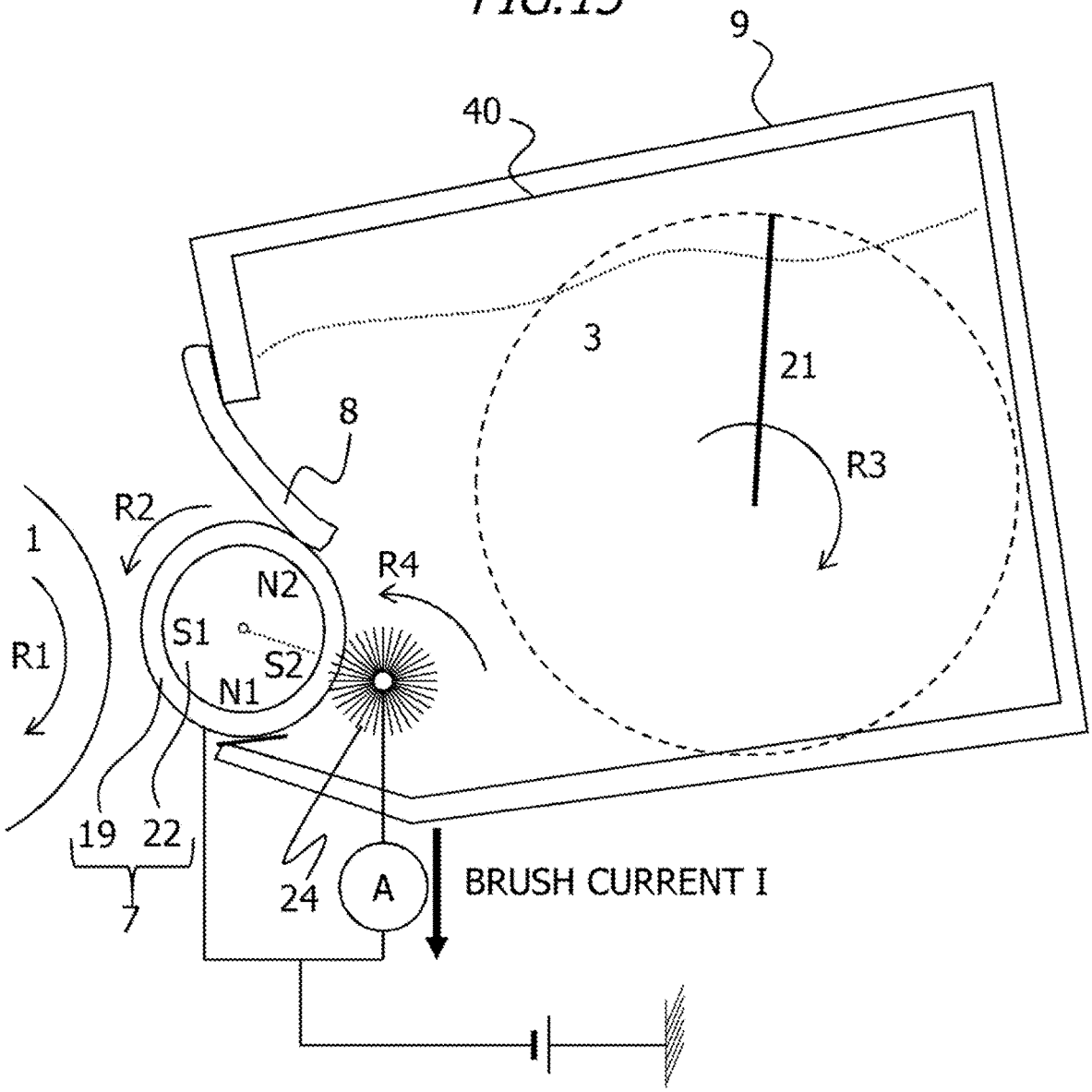
FIG. 13 is a cross-sectional diagram of a developing apparatus according to the second embodiment.

Next, a configuration of a developing apparatus including the brush roller 24 in the second embodiment is described with reference to FIG. 13. First, in regard to the contact state, the brush roller 24 is disposed such that the tip of the brush fiber 24*a* on the outer circumference is in contact with the surface of the developing roller 7 near the magnetic pole position of the magnet roller 22. In addition, the position of the core 24*b* is determined such that the tip of the brush fiber 24*a* on the outer circumference of the brush roller 24 is in contact with the surface of the developing roller 7 near the magnetic pole position of the magnet roller 22. The brush roller 24 rotates at a peripheral speed of 100 rpm. The developing roller 7 and the brush roller 24 rotate in opposite directions at a contact position between the developing roller 7 and the brush roller 24. As illustrated in FIG. 13, the brush roller 24 as a moving member is disposed at a position opposed to any of the magnetic pole positions among a plurality of magnetic poles of the magnet roller 22. For example, the contact position of the brush roller 24 with the developing roller 7 is opposed to any of the magnetic pole positions among the plurality of magnetic poles of the magnet roller 22.

Effects in the Second Embodiment

The effects obtained when the brush roller 24 rotates are described with reference to the following Table 2.

TABLE 2

| | Conventional example | First embodiment Fixed brush | Second embodiment Rotating brush |
|---|---|---|---|
| Toner sticking (restriction failure) | Very good | Good | Very good |
| Toner stripped (fogging) | Bad | Good | Good |
| Load on toner (density decrease) | Bad | Ordinary | Ordinary |

First, when the brush roller 24 rotates in the reverse direction, a chance of contact between the brush fiber 24*a* on the brush roller 24 and the developing roller 7 increases. Due to the increased chance of contact, a chance of movement of the magnetic chains 25 on the developing roller 7 increases, and the moving effect improves.

Second, when the brush roller 24 rotates in a direction opposite to the rotation of the developing roller 7, the toner 3 remaining in the brush roller 24 can be effectively removed. In the configuration in the second embodiment in which the brush roller 24 is fixed, when the cohesion degree of the toner 3 becomes higher, the toner 3 more easily adheres to the brush fibers 24*a* of the brush roller 24. When the toner 3 adheres to the brush fibers 24*a* of the brush roller 24 and the toner 3 remains between the brush fibers 24*a* of the brush roller 24, the brush fibers 24*a* cannot roll the magnetic chains 25 and the moving performance decreases.

Figure 14:
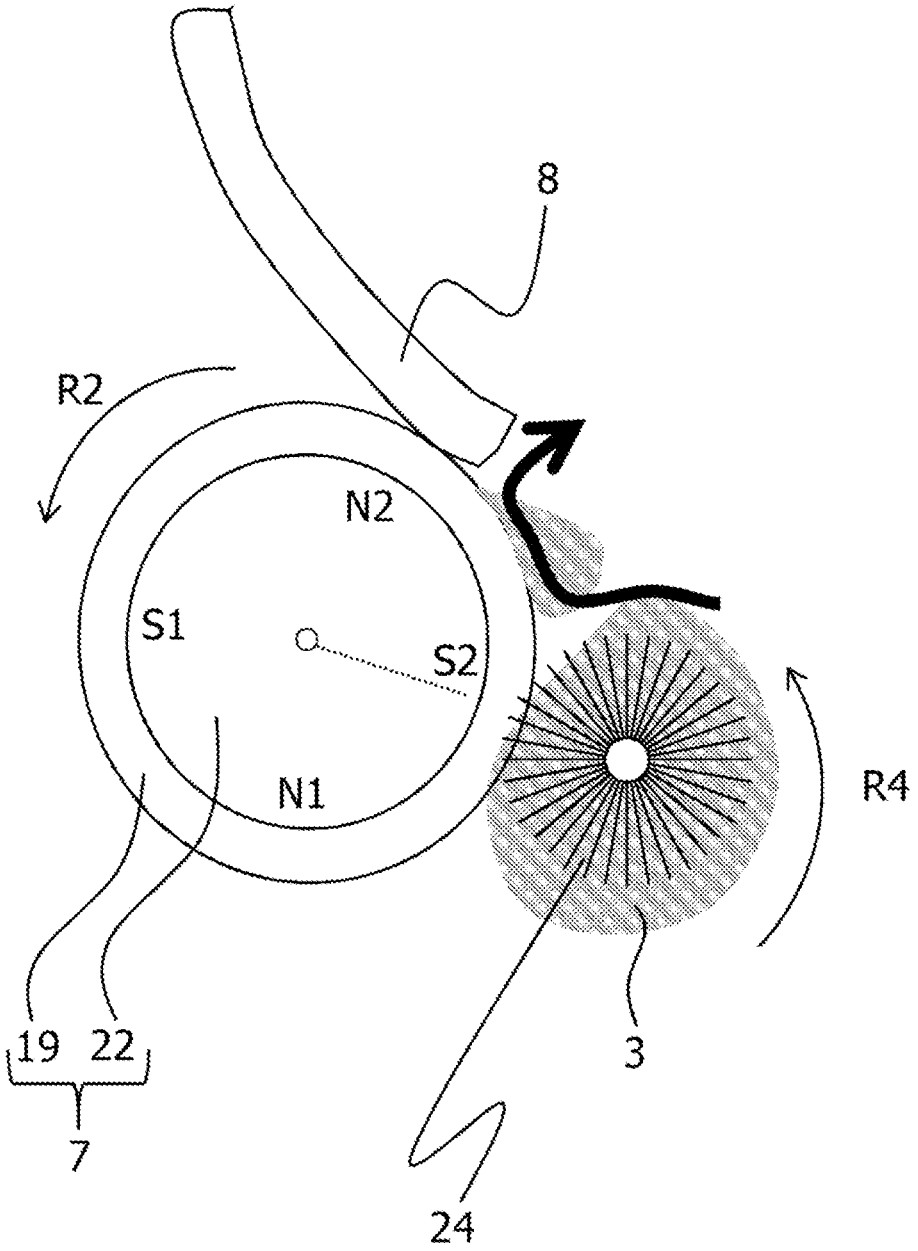
FIG. 14 is a cross-sectional diagram of the developing apparatus according to the second embodiment.

In the configuration in the second embodiment, on the other hand, the brush roller 24 rotates in a direction opposite to the rotation direction of the developing roller 7. Thus, as illustrated in FIG. 14, the toner 3 in the brush roller 24 is attracted by magnetic attractive force of the magnet roller 22 on the upstream side of the contact position between the developing roller 7 and the brush roller 24 in the rotation direction of the brush roller 24. The toner 3 attracted by the magnetic attractive force moves to the downstream side of the contact position between the developing roller 7 and the brush roller 24 in the rotation direction of the developing roller 7, and is conveyed toward the contact position between the developing roller 7 and the developing blade 8. A part of the toner 3 remaining in the brush roller 24 is discharged by the magnetic attractive force of the magnet roller 22 on the upstream side of the contact position between the developing roller 7 and the brush roller 24. In this manner, the brush fibers 24*a* can easily roll the magnetic chains 25 at the contact position between the brush roller 24 and the developing roller 7.

Due to the above-mentioned two effects, the performance of the brush roller 24 for moving the magnetic chains 25 on the developing roller 7 can be improved to improve a restriction failure that occurs when the toner 3 sticks to the developing roller 7. As described above, the configuration in the second embodiment can maintain the moving effect for a long period of time even in the state in which the toner 3 easily remains in the brush roller 24 due to an increase in cohesion degree of the toner 3 caused by degradation of the toner 3 or environmental fluctuations.

Third Embodiment

Outline of the Third Embodiment

Figure 15:
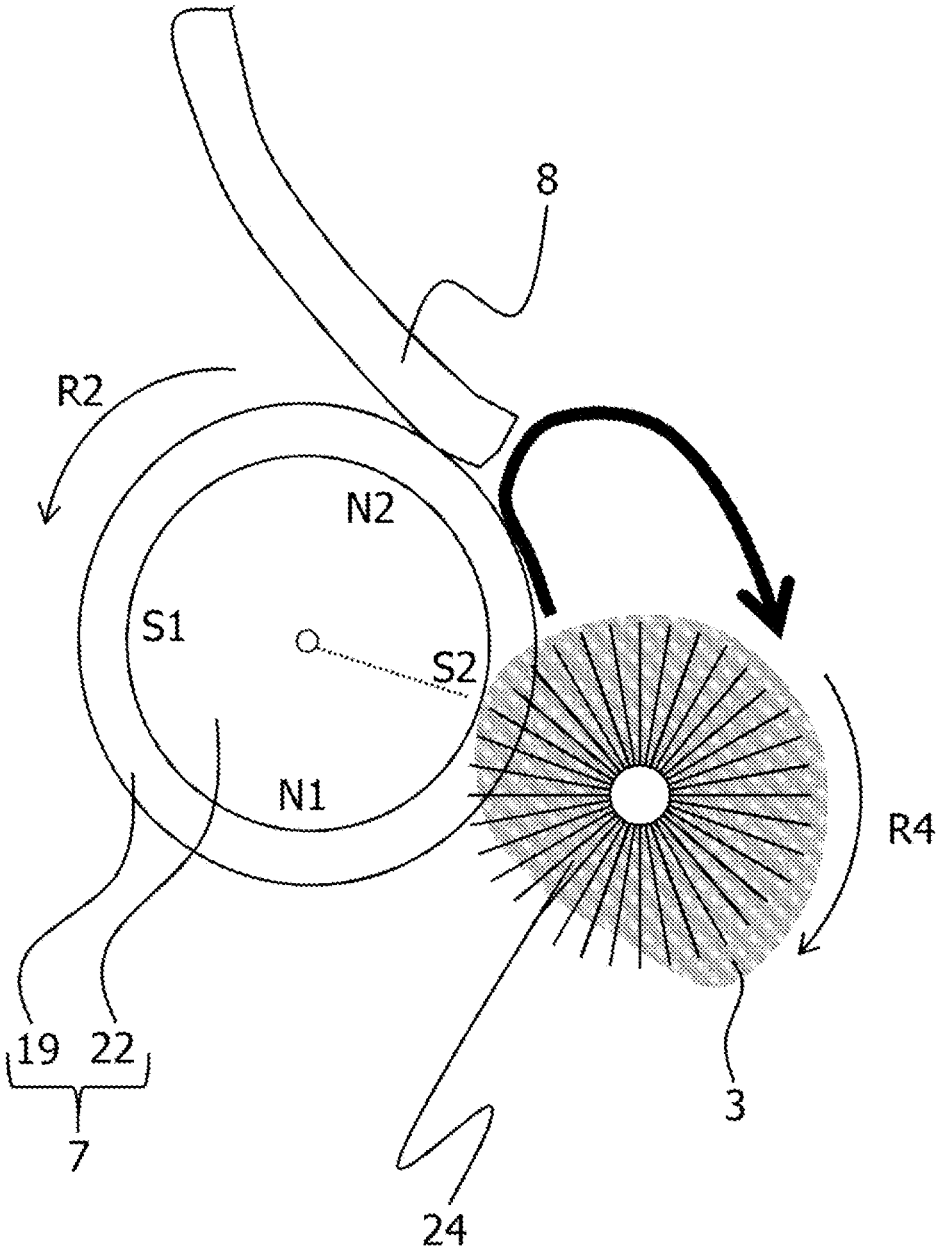
FIG. 15 is a cross-sectional diagram of the developing apparatus according to a third embodiment.

The third embodiment is different from the first embodiment in that the brush fibers 24*a* are spirally wound around the core (metal such as SUS) 24*b* by double-sided tape 24*d* to have a roller shape as illustrated in FIGS. 12A and 12B. The third embodiment is different from the second embodiment in that the brush roller 24 is in contact with the developing roller 7 in a forward direction as illustrated in FIG. 15. Descriptions of parts overlapping with descriptions in the first and second embodiments are omitted in the third embodiment.

Configuration and Effects in the Third Embodiment

Next, a configuration and its effects in the third embodiment are described. In the third embodiment, the developing roller 7 and the brush roller 24 rotate in the same direction at a contact position between the developing roller 7 and the brush roller 24. Thus, as the first effect in the third embodiment, the number of times of rubbing between the brush roller 24 and the developing roller 7 can be set smaller than in the first and second embodiments. The number of times of rubbing in the third embodiment is set to a condition that no restriction failure occurs, and as long as the restriction failure does not occur, any number of times of rubbing can be set, and there is an adjustment range on the side where the number of times of rubbing is small. Thus, the configuration in the third embodiment can reduce rubbing damage to the toner 3 while maintaining the movement of the toner layer, and is thus superior to the first and second embodiments in terms of long lifetime of the developing apparatus related to the rubbing damage and the density decrease in the latter half in the durable period.

In the third embodiment, the developing roller 7 and the brush roller 24 rotate in the same direction at the contact position between the developing roller 7 and the brush roller 24. Thus, as the second effect in the third embodiment, the circulation of the toner 3 in a restriction region improves. FIG. 15 is a diagram illustrating the arrangement of the developing roller 7, the developing blade 8, and the brush roller 24. As illustrated in FIG. 15, the toner 3 restricted by the developing blade 8 drops on the brush roller 24. The developing roller 7 and the brush roller 24 rotate in the same direction at the contact position between the developing roller 7 and the brush roller 24, and hence the toner 3 that has dropped on the brush roller 24 moves toward a rotation direction R4 of the brush roller 24. In this manner, the toner 3 that has dropped on the brush roller 24 can be returned to the inside of the developer container 9. If the toner 3 that has dropped on the developing blade 8 remains near the boundary between the developing roller 7 and the brush roller 24, a problem of disturbance of the toner layer due to excessive supply of the toner 3 on the developing roller 7 or toner packing due to insufficient circulation of the toner 3 may be caused. Thus, when the brush roller 24 is in contact with the developing roller 7 in the forward direction, there is an advantage in that the problem of toner residual in the above-mentioned arrangement can be solved, and hence the configuration in the third embodiment is superior to the first and second embodiments because the problem of toner residual can be solved.

On the other hand, the case where the toner 3 remains between the brush fibers 24*a* of the brush roller 24 and the moving performance decreases when the cohesion degree of the toner 3 increases as in the second embodiment is described. In the configuration in the third embodiment, the number of times of rubbing is small from the beginning. By disposing the brush roller 24 so as to be in contact with a part of the inner wall of the toner storing chamber 40 or providing a scraper so as to enter the inside of the brush roller 24, the toner 3 in the brush roller 24 can be easily removed. The scraper may be a part of the inner wall of the toner storing chamber 40. A part of the inner wall of the toner storing chamber 40 may protrude to the inner side of the toner storing chamber 40.

Superior points of the third embodiment to the conventional example and the first and second embodiments are listed in the following Table 3.

TABLE 3

| | Conventional example | First embodiment Fixed brush | Second embodiment Rotating brush | Third embodiment Rotating brush |
|---|---|---|---|---|
| Toner sticking (restriction failure) | Very good | Good | Very good | Very good |
| Toner stripped (fogging) | Bad | Good | Good | Good |
| Load on toner (density decrease) | Bad | Ordinary | Ordinary | Good |

As understood from Table 3, in the third embodiment, the stripping of the toner 3 from the developing roller surface 27 is suppressed while solving the problem (restriction failure) in that the toner 3 sticks to the developing roller surface. Thus, in the third embodiment, the state in which the charge amount of the toner 3 is low as in the conventional example can be avoided, and hence there is an effect on the stripping (fogging) of the toner 3 similarly to the first and second embodiments. The third embodiment has a feature that the brush roller 24 is in contact with the developing roller 7 in the forward direction. The number of times of rubbing between the developing roller 7 and the brush roller 24 can be reduced under the condition that no restriction failure occurs, and hence there is an effect on the load on the toner 3 (density decrease). Thus, the third embodiment has a particular effect that is not obtained by the conventional example and the first and second embodiments.

Fourth Embodiment

A configuration in the fourth embodiment is described below. The fourth embodiment is different from the second embodiment in the S2 pole position, the magnitude of magnetic force Fmag of the magnet roller 22, the position of the brush roller 24, and the height of a toner agent surface 41 of the toner 3 in the toner storing chamber 40 by changing the position of the toner storing chamber 40. The toner agent surface 41 is an example of a developer surface. The toner agent surface 41 of the toner 3 in the toner storing chamber 40 is the top surface of the toner 3 in the toner storing chamber 40. The other configurations in the fourth embodiment are the same as the configurations in the second embodiment. According to the configuration in the fourth embodiment, the circulation of the toner 3 around the brush roller 24 is made smooth. In this manner, even when the number of printed sheets has advanced and the toner 3 in the process cartridge 20 has degraded to improve the cohesion degree, the moving effect of the brush roller 24 can be maintained while suppressing the stripping of the toner 3.

The configuration in the fourth embodiment is described in detail below. Regarding the definition of the positional relation of the members in the fourth embodiment, the process cartridge 20 is inserted in the image forming apparatus main body M and located at an image forming operating position.

S2 Pole Position

Figure 16:
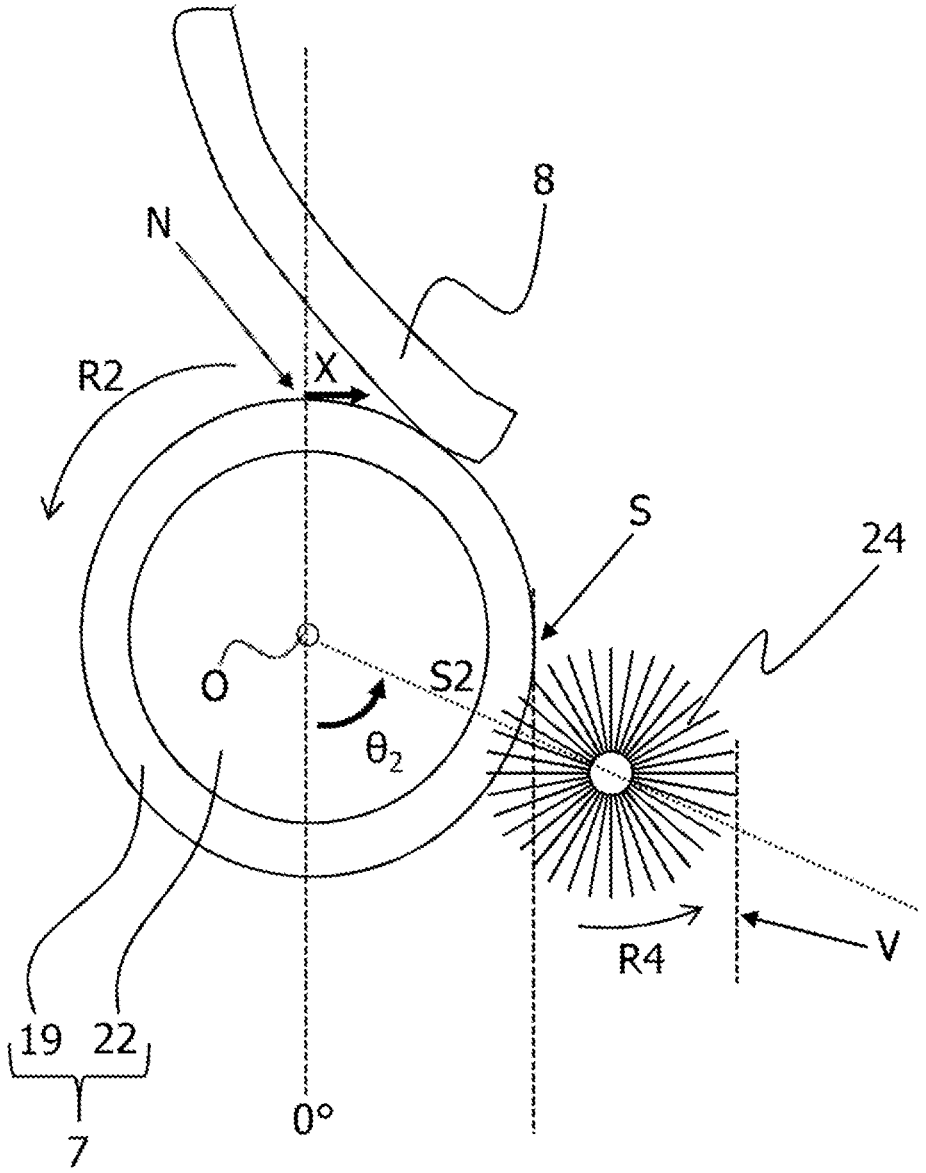
FIG. 16 is an explanatory diagram of the position of a brush roller in the second embodiment.
Figure 17:
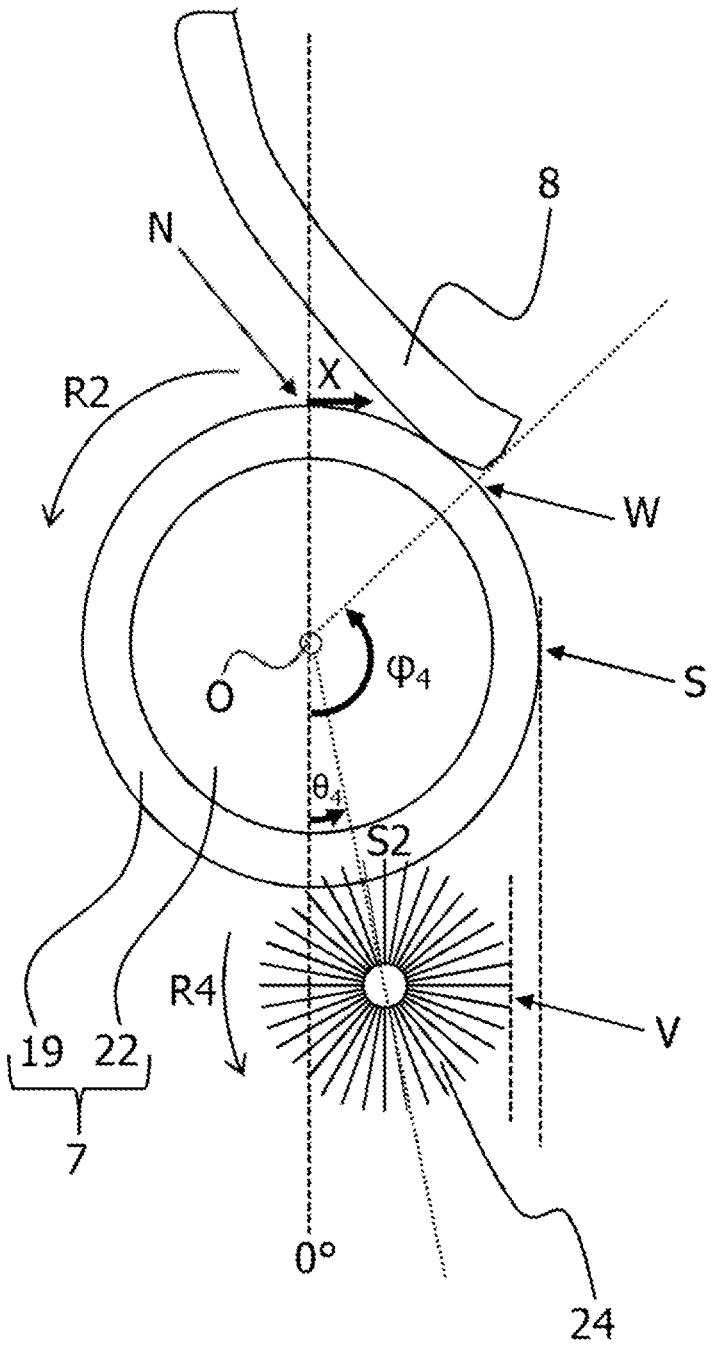
FIG. 17 is an explanatory diagram of the position of a brush roller in a fourth embodiment.

FIG. 16 illustrates the S2 pole position in the second embodiment, and FIG. 17 illustrates the S2 pole position in the fourth embodiment. In FIG. 16 and FIG. 17, it is assumed that the center of the magnet roller 22 is the origin of polar coordinates, the vertically downward direction from the origin is 0°, and the angle increases from 0° in the counterclockwise direction. On this assumption, an angle θ2 of the S2 pole in the second embodiment is 70°, and an angle θ4 of the S2 pole in the fourth embodiment is 10°. Specifically, in the second embodiment, the angle θ2 between a line extending vertically downward from the center of the magnet roller 22 and a line extending from the center of the magnet roller 22 to the rotating center of the brush roller 24 is 70°. In the fourth embodiment, the angle θ2 between a line extending vertically downward from the center of the magnet roller 22 and a line extending from the center of the magnet roller 22 to the rotating center of the brush roller 24 is 10°.

Description of Magnetic Force Fmag

Figure 18:
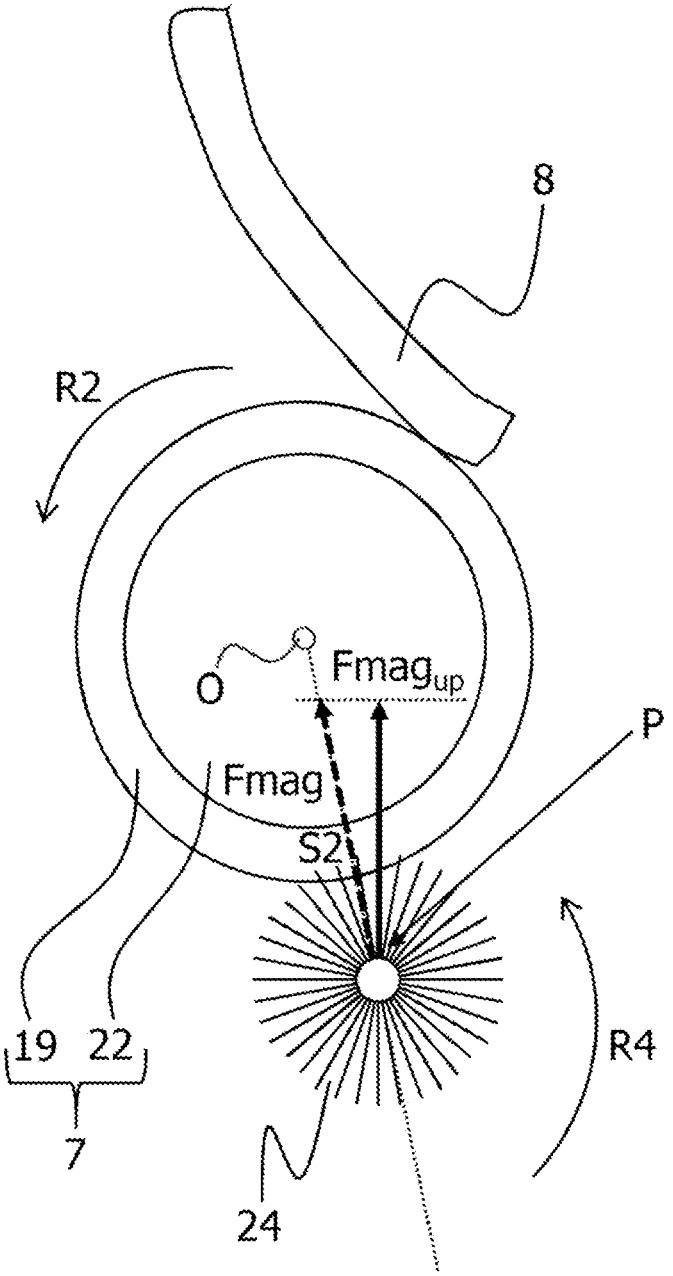
FIG. 18 is an explanatory diagram of magnetic force in the fourth embodiment.

The magnetic force Fmag of the magnet roller 22 in the fourth embodiment is described with reference to FIG. 18. The magnetic force Fmag is a force by which magnetic flux density B generated by the magnet roller 22 acts on one toner 3, and is a magnetic force at a position P closest to the developing roller 7 on the peripheral surface of the rotating shaft of the brush roller 24. When a vertical component of Fmag at the position P is $Fmag_{up}$, the weight of the toner 3 having the weight-average particle diameter of the toner 3 used in the fourth embodiment is m, and the acceleration of gravity is g, the relation between $Fmag_{up}$ and m×g (product of m and g) is expressed by the following Expression (3).

$$Fmag_{up} > m \times g \tag{3}$$

The distance between the position P and the rotating center 0 of the developing roller 7 is a distance H. In the fourth embodiment, the distance H is 12 mm. The above-mentioned Fmag is described in detail below. Fmag is expressed by the following Expression (4). "Fr" represents a force in a direction normal to the surface of the developing roller 7, and "$F_\theta$" represents a force in a direction tangent to the surface of the developing roller 7.

[Expression (4)]

$$\vec{F}mag = (F_r, F_0) \tag{4}$$

"Fr" and "$F_\theta$" are expressed by the following Expression (5).

[Expression (5)]

$$\vec{F}\,mag = (F_\gamma, F_\theta) = 4\pi b^3 \frac{(\mu - \mu_0)}{\mu_0(\mu + \mu_0)}\left(\frac{1}{2}\frac{\partial}{\partial r} + \frac{1}{r} - \frac{1}{2}\frac{\partial}{r\partial\theta}\right)|\vec{B}|^2 \tag{5}$$

Here "$\mu_0$" represents the magnetic permeability in vacuum, "μ" represents the magnetic permeability of the toner 3, "b" represents the radius of the toner 3, "B" represents the magnetic flux density, "Br" represents the magnetic flux density in a direction normal to the surface of the developing roller 7, and "$B_\theta$" represents the magnetic flux density in a direction tangent to the surface of the developing roller 7. Thus, when the weight-average particle diameter of the toner 3, the magnetic permeability μ of the toner 3, "Br", and "$B_\theta$" are known, the magnetic force Fmag can be determined. The magnetic permeability μ of the toner 3 is measured with an external magnetic field of 387.9 kA/m by using a vibrating magnetometer VSM P-1-10 (manufactured by TOEI INDUSTRY CO., LTD.).

Next, a method of measuring "Br" is described. The intensity of a magnetic field from the developing roller 7 over the photosensitive drum 1 is measured by the polar coordinate system, in which the rotating center of the developing roller 7 is the origin, based on which the nearest position between the developing roller 7 and the photosensitive drum 1. As a measurement device, a gaussmeter (manufactured by F.W.Bell Inc.) is used. A jig capable of rotating the magnet roller 22 as magnetic field generating means about an axis overlapping the rotating center of the developing roller 7 is prepared, and a probe of the gaussmeter is fixed placed at a predetermined normal direction distance (in the fourth embodiment, position away from origin by H=12 mm) The magnet roller 22 on the jig is rotated for each predetermined angle, and the value of the gaussmeter is recorded, so that the intensity can be measured.

Next, "$B_\theta$" can be determined from the magnetic flux density Br on the basis of the following Expression (6).

[Expression (6)]

$$B_\theta = -\frac{\partial A_Z(r,\theta)}{\partial r} \quad \left(A_Z(R,\theta) = \int_0^\theta RB_r\,d\theta\right) \tag{6}$$

By substituting the measured and calculated "μ", "Br", and "$B_\theta$" into the above expression, Fmag can be derived, and the vertically upward component of Fmag is $Fmag_{up}$. In the fourth embodiment, the magnetic susceptibility of the toner 3 is 1.0, the weight-average particle diameter of the toner 3 is 7 μm, and the specific gravity of the toner 3 is 1.5/cm$^3$.

From the conditions described above, $Fmag_{up}=1.0\times10^{-10}$N and mg=$2.1\times10^{-14}$N in the fourth embodiment, which satisfy Expression (3).

Position of Brush Roller

Next, the position of the brush roller 24 in the second and fourth embodiments is described with reference to FIG. 16 and FIG. 17. FIG. 16 is an explanatory diagram of the position of the brush roller 24 in the second embodiment. FIG. 17 is an explanatory diagram of the position of the brush roller 24 in the fourth embodiment. In FIG. 16 and FIG. 17, it is assumed that the center of the magnet roller 22 is the origin of polar coordinates, the vertically downward direction from the origin is 0°, and the angle increases from 0° in the counterclockwise direction. In this case, as illustrated in FIG. 16, the rotating center of the brush roller 24 in the second embodiment is present at a position of 70°. On the other hand, as illustrated in FIG. 17, the rotating center of the brush roller 24 in the fourth embodiment is present at a position of 10°. In other words, the brush roller 24 in the fourth embodiment is also present at a position opposed to the S2 pole. In the configuration in the fourth embodiment, the brush roller 24 is disposed on the vertically lower side of the developing roller 7.

In the fourth embodiment, the distance between the center of the magnet roller 22 and the rotating center of the brush roller 24 and the diameter of the brush roller 24 are the same as in the second embodiment. For example, the diameter of the brush roller 24 is φ11 mm. It is assumed that the upstream direction in the rotation direction of the developing roller 7, which is the horizontal direction from a point N located vertically uppermost on the peripheral surface of the developing roller 7, is an X direction. As illustrated in FIG. 17, in the configuration in the fourth embodiment, a point S farthest in the X direction among points present on the peripheral surface of the developing roller 7 is located toward the X direction side than a point V farthest in the X direction among points present on the outer circumference of the brush roller 24. Thus, in the configuration in the fourth embodiment, the brush roller 24 does not protrude from the upstream side in the rotation direction of the developing roller 7 when seen from the vertically upper side. In other words, the brush roller 24 and an end portion of the developing roller 7 on the upstream side in the rotation direction of the developing roller 7 do not overlap each other in the vertical direction. As illustrated in FIG. 17, the brush roller 24 and the point S, which is present farthest in the X direction among points present on the peripheral surface of the developing roller 7, do not overlap each other in the vertical direction. In this case, a contact position between the developing roller 7 and the brush roller 24 is present on a side more upstream than the point S in the rotation direction of the developing roller 7. As illustrated in FIG. 16, the configuration in the second embodiment is opposite to the configuration in the fourth embodiment, and the point V, which is present farthest in the X direction among points present on the outer circumference of the brush roller 24, is present toward the X direction side than the point S present farthest in the X direction among points present on the peripheral surface of the developing roller 7. Thus, in the configuration in the second embodiment, a part of the brush roller 24 protrudes from the upstream side in the rotation direction of the developing roller 7 when seen from the vertically upper side. In other words, the brush roller 24 and an end portion of the developing roller 7 on the upstream side in the rotation direction of the developing roller 7 overlap each other in the vertical direction. As illustrated in FIG. 16, the brush roller 24 and the point S, which is present farthest in the X direction among points present on the peripheral surface of the developing roller 7, overlap each other in the vertical direction. The point N is an example of "first point located vertically uppermost on peripheral surface of developer bearing member". The X direction is an example of "upstream direction (first direction) in rotation direction of developer bearing member, which is horizontal direction from first point". The point V is an example of "fourth point present farthest in first direction on peripheral surface of moving member".

The position of the brush 23 in the first embodiment may be the same as the position of the brush roller 24 in the fourth embodiment. In other words, in the configuration in the first embodiment, the brush 23 may be disposed on the vertically lower side of the developing roller 7. In the configuration in the first embodiment, the point S present farthest in the X direction among points present on the peripheral surface of the developing roller 7 may be present toward the X direction side than a point present farthest in the X direction among points present on the outer circumference of the brush 23. In this case, the brush 23 does not protrude from the upstream side in the rotation direction of the developing roller 7 when seen from the vertically upper side. In other words, the brush 23 and an end portion of the developing roller 7 on the upstream side in the rotation direction of the developing roller 7 do not overlap each other in the vertical direction. In addition, the configuration in the fourth embodiment can be applied to the configuration in the third embodiment.

Position of Toner Storing Chamber

Figure 19:
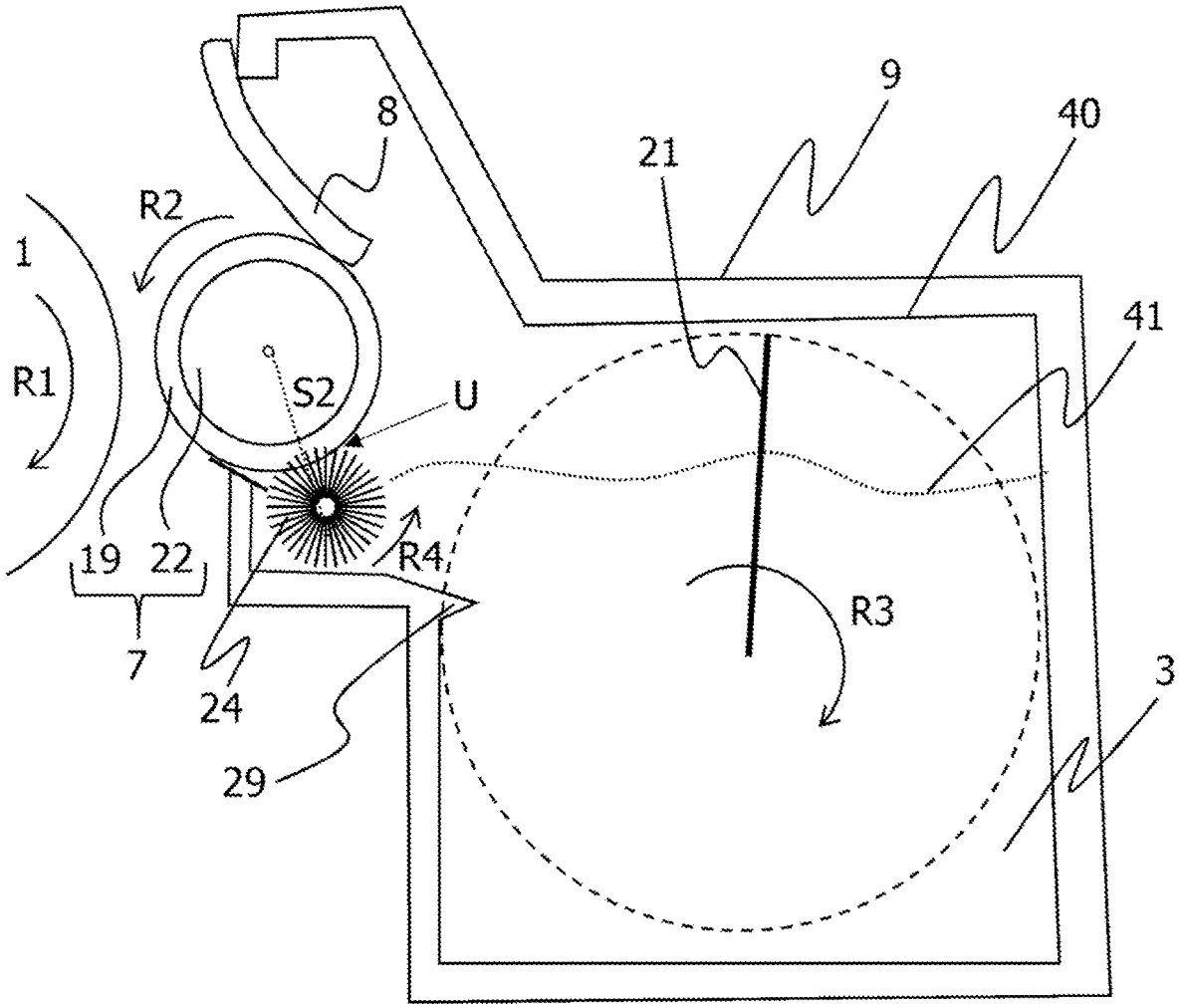
FIG. 19 is a cross-sectional diagram of a developing apparatus according to the fourth embodiment.

The fourth embodiment is different from the second embodiment in the position of the toner storing chamber 40 in which the toner 3 in the developer container 9 is stored. As illustrated in FIG. 13, the toner storing chamber 40 in the second embodiment is present at substantially the same height as the developing roller 7. Herein, a position located on the upper side in the gravitational direction is referred to as "high", and a position located on the lower side in the gravitational direction is referred to as "low". FIG. 19 illustrates a cross-section of the developer container 9 in the fourth embodiment. As compared with the second embodiment, in the fourth embodiment, the toner storing chamber 40 is present at a position substantially lower than the developing roller 7. When the amount of toner 3 in the process cartridge 20 is large (at start of use), the toner agent surface 41 of the toner 3 is present at the highest position. When the toner agent surface 41 of the toner 3 is present at the highest position, the toner agent surface 41 of the toner 3 in the toner storing chamber 40 is located at a position lower than a position U on the most downstream side of a contact surface between the developing roller 7 and the brush roller 24 in the rotation direction of developing roller 7. Thus, when the toner agent surface 41 is located on the vertically lower side of the contact position between the developing roller 7 and the brush roller 24, at least a part of the brush roller 24 is exposed from the toner agent surface 41. Correspondingly, the toner conveying member 21 in the fourth embodiment is also disposed at a low position as compared with the second embodiment, so that the toner 3 present on the lower side of the toner storing chamber 40 is pumped onto the developing roller 7. The toner conveying member 21 is formed from a PET sheet having one end fixed to the rotating shaft, and rotates about the rotating axis center to convey the toner 3. In particular, when a free end of the toner conveying member 21 passes a protruded portion 29 provided on the wall surface of the toner storing chamber 40, the toner 3 is raised in the direction in which the developing roller 7 is disposed. The position of the toner agent surface 41 of the toner 3 in the toner storing chamber 40 in the first embodiment may be the same as the position of the toner agent surface 41 of the toner 3 in the toner storing chamber 40 in the fourth embodiment. Specifically, in the configuration in the first embodiment, the toner agent surface 41 of the toner 3 in the toner storing chamber 40 may be located at a position lower than the most downstream position of the contact surface between the developing roller 7 and the brush 23 in the rotation direction of the developing roller 7.

Tip Position of Developing Blade

As illustrated in FIG. 17, the developing blade 8 in the fourth embodiment is in contact with the developing roller 7 on the free end side. When it is assumed that the center of the magnet roller 22 is the origin of polar coordinates, the vertically downward direction from the origin is 0°, and the angle increases from 0° in the counterclockwise direction, an angle φ4 of the tip position of the developing blade 8 on the free end side in the fourth embodiment is 130°. This is the same as in the second embodiment. It is assumed that the upstream direction in the rotation direction of the developing roller 7, which is a horizontal direction from a point N located on the vertically uppermost side on the peripheral surface of the developing roller 7, is an X direction. A point W closest to the tip position of the developing blade 8 among points present on the peripheral surface of the developing roller 7 is present on a side more downstream in the rotation direction of the developing roller 7 than a point S present farthest in the X direction among points present on the peripheral surface of the developing roller 7. The point W is an example of "second point closest to tip position of restricting member on peripheral surface of developer bearing member". The point S is an example of "third point present farthest in first direction on peripheral surface of developer bearing member". The tip position of the developing blade 8 in the first embodiment may be the same as the tip position of the developing blade 8 in the fourth embodiment.

Effects in the Fourth Embodiment

Figure 20:
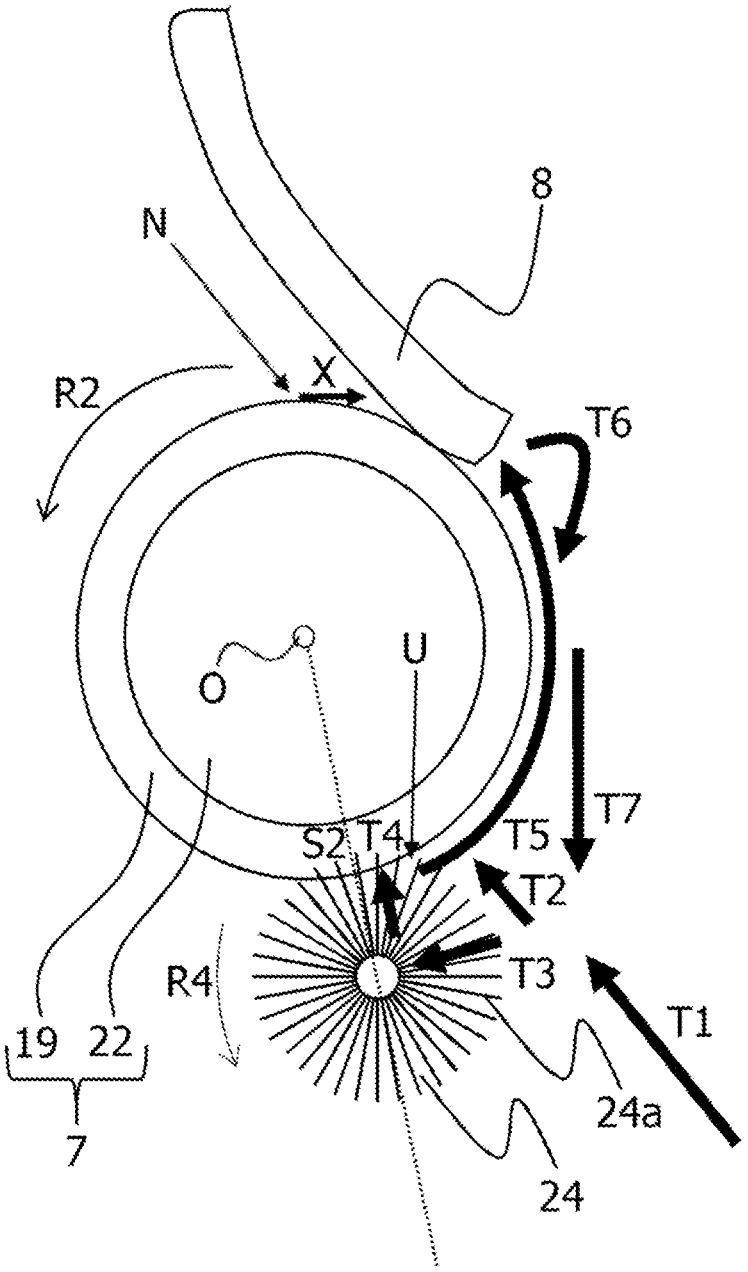
FIG. 20 is an explanatory diagram of the circulation of toner in the fourth embodiment.

As described above in the second embodiment, when the cohesion degree of the toner 3 increases, the toner 3 remains between the brush fibers 24*a* of the brush roller 24, and the brush fibers 24*a* cannot roll the magnetic chains 25 and the moving performance of the brush roller 24 decreases. The configuration in the fourth embodiment enables the circulation of the toner 3 around the brush roller 24 to be smooth to suppress the decrease in moving performance of the brush roller 24. The functions and effects of the fourth embodiment, that is, the motion of the toner 3 around the brush roller 24, is described in detail below with reference to FIG. 20.

In the fourth embodiment, the toner agent surface 41 is located at a position lower than the position U on the most downstream side of the contact surface between the developing roller 7 and the brush roller 24 in the rotation direction of the developing roller 7. Thus, the toner 3 is pumped by the toner conveying member 21, and the toner 3 is conveyed in the direction in which the developing roller 7 and the brush roller 24 are disposed (arrow T1). Most of the toner 3 conveyed onto the brush roller 24 rides on the brush roller 24 and is conveyed to near the developing roller 7 (arrow T2), and moves to the developing roller 7 by magnetic force of the magnet roller 22. A part of the toner 3 conveyed onto the brush roller 24 by the toner conveying member 21 enters between the brush fibers 24*a* (arrow T3). However, when Expression (3) is satisfied as in the configuration in the fourth embodiment, even the toner 3 that has entered the deepest portion (root of brush fiber 24*a*) of the brush roller 24, that is, the peripheral surface of the rotating shaft of the brush roller 24 can be moved to the developing roller 7 (arrow T4).

When the developing roller 7 rotates, the toner 3 that has moved onto the developing roller 7 is conveyed to near the developing blade 8 (arrow T5). A part of the toner 3 that has been conveyed to near the developing blade 8 passes a contact region between the developing roller 7 and the developing blade 8 and is supplied to a developing zone. Most of the other toner 3 that has been conveyed to near the developing blade 8 is restricted by the developing blade 8 and stripped off from the developing roller 7. A part of the stripped toner 3 returns onto the developing roller 7 (arrow T6), and the other toner 3 drops downward in the direction of gravity due to gravitational force (arrow T7). With the configuration in the fourth embodiment, the dropped toner 3 does not return to the brush roller 24 again but is stored in the toner storing chamber 40.

According to the configuration in the fourth embodiment as described above, as compared with the configuration in the second embodiment, a part of the toner 3 that has been conveyed from the toner storing chamber 40 other than the toner 3 supplied to the developing zone can reliably return to the toner storing chamber 40. The specific effects in the fourth embodiment are described with reference to Table 4.

TABLE 4

| | Initial use of process cartridge | | After printing of 50,000 sheets | |
|---|---|---|---|---|
| | Configuration in Second Embodiment | Configuration in Fourth Embodiment | Configuration in Second Embodiment | Configuration in Fourth Embodiment |
| Toner sticking (restriction failure) | Good | Good | Ordinary | Good |
| Toner stripped (fogging) | Good | Good | Good | Good |

In Table 4, the moving effect of the brush roller 24 and the suppressing effect of stripping in the configuration in the second embodiment and the configuration in the fourth embodiment are confirmed at the time of the start of use of the process cartridge 20 and after 50,000 sheets of horizontal line images of a printing ratio of about 2% are printed. At the start of use, there is no difference between the second embodiment and the fourth embodiment in the moving effect of the brush roller 24 (effect of suppressing restriction failure due to sticking of toner 3) and the effect of suppressing fogging that degrades when the triboelectricity of the toner 3 decreases after the toner 3 is stripped. After the printing of 50,000 sheets, there is no difference between the second embodiment and the fourth embodiment in the effect of suppressing fogging that degrades after the toner 3 is stripped, but there is a difference in the effect of suppressing a restriction failure due to sticking of the toner 3. Specifically, in an image sample after the printing of 50,000 sheets in the configuration in the second embodiment, extremely minor density unevenness caused by a restriction failure occurred in a halftone image of a printing ratio of about 50%. In the configuration in the fourth embodiment, on the other hand, density unevenness caused by a restriction failure did not occur. This indicates that the configuration in the fourth embodiment can maintain and improve the moving effect while suppressing the stripping of the toner 3 even after the printing of 50,000 sheets.

Figure 21:
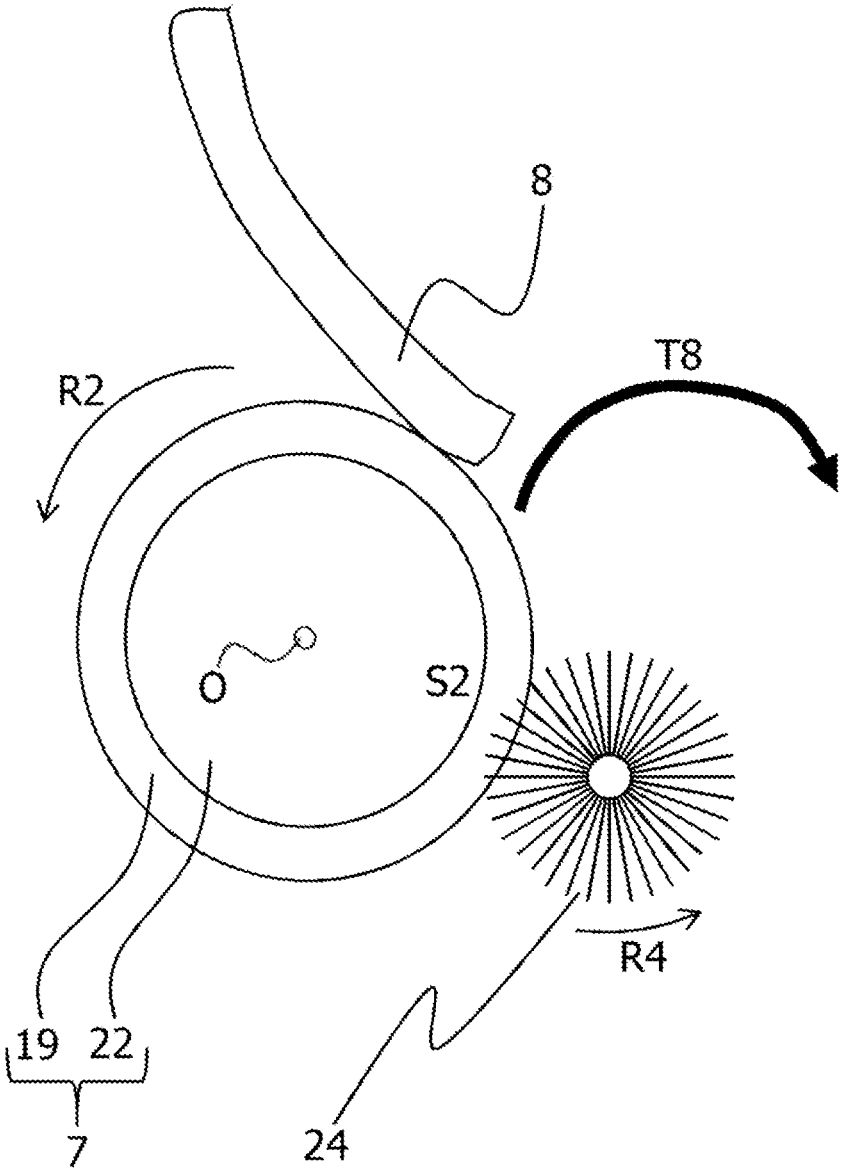
FIG. 21 is an explanatory diagram of the circulation of toner at the time of initial use in the second embodiment.
Figure 22:
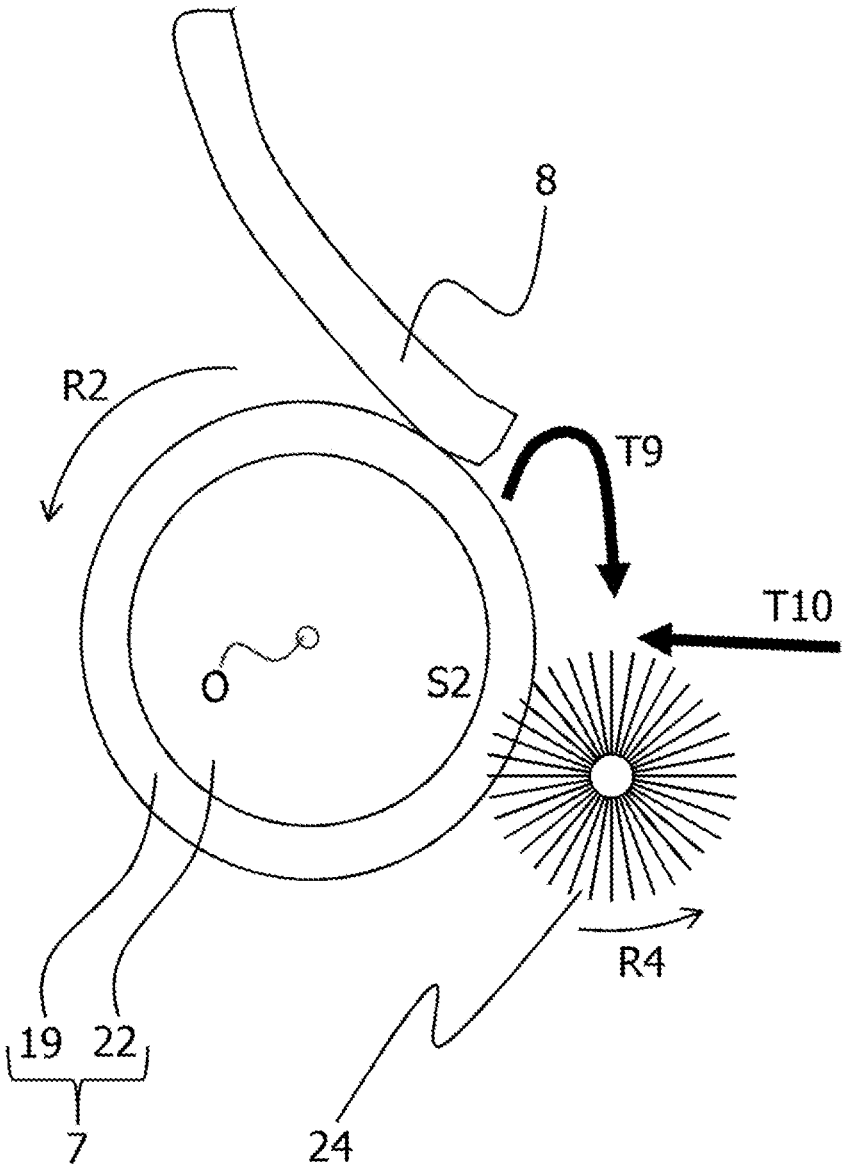
FIG. 22 is an explanatory diagram of the circulation of toner after printing of 50,000 sheets in the second embodiment.

The reason why extremely minor halftone density unevenness caused by a restriction failure occurred after the printing of 50,000 sheets only in the configuration in the second embodiment is described with reference to FIG. 21 and FIG. 22. FIG. 21 illustrates the circulation of the toner 3 at the start of use of the process cartridge 20 in the configuration in the second embodiment. FIG. 22 illustrates the circulation of the toner 3 after printing of 50,000 sheets in the configuration in the second embodiment. In the configuration in the fourth embodiment, the toner 3 supplied from the toner storing chamber 40 does not enter between the brush fibers 24*a*, but the toner 3 is restricted by the developing blade 8 and returns to the toner storing chamber 40 again. However, in the configuration in the second embodiment, the toner 3 is not circulated unlike the fourth embodiment. In the configuration in the second embodiment, as illustrated in FIG. 21, when the cohesion degree of the toner 3 at the start of use of the process cartridge 20 is not high, a certain amount of the toner 3 can return to the toner storing chamber 40 (arrow T8) due to the momentum of the toner 3 conveyed by the rotation of the developing roller 7.

However, in the configuration in the second embodiment, as illustrated in FIG. 22, when the cohesion degree of the toner 3 in the process cartridge 20 increases after printing of 50,000 sheets, most of the toner 3 restricted by the developing blade 8 returns to the brush roller 24 again (arrow T9). In the configuration in the second embodiment, due to the toner 3 further supplied from the toner storing chamber 40 (arrow T10), the toner 3 is excessively supplied to the brush roller 24, and the toner 3 that has entered between the brush fibers 24*a* of the brush roller 24 cannot return onto the developing roller 7. Thus, the toner 3 remains on the brush roller 24. As a result, it is considered that the brush fibers 24*a* cannot roll the magnetic chains 25, and the moving performance of the brush roller 24 decreases.

As described above, according to the configuration in the fourth embodiment, the circulation of the toner 3 around the brush roller 24 is smooth. Thus, even when the number of printed sheets has advanced and the toner 3 in the process cartridge 20 has degraded to improve the cohesion degree, the moving effect of the brush roller 24 can be maintained and improved while suppressing the stripping of the toner 3.

Fifth Embodiment

A configuration in the fifth embodiment is described below. The fifth embodiment is different from the fourth embodiment in the tip position of the developing blade 8. For example, there may be a case where the developing blade 8 is required to be brought into contact with the developing roller 7 at a lower position than in the configuration in the fourth embodiment due to an apparatus configurational reason that the size of the image forming apparatus main body M needs to be decreased. Even in such a case, the configuration in the fifth embodiment can maintain and improve the moving effect of the brush roller 24 while suppressing the stripping of the toner 3. The other configurations in the fifth embodiment are the same as the configurations in the fourth embodiment.

The configuration in the fifth embodiment is described in detail below. Regarding the definition of the positional relation of the members in the fifth embodiment, the process cartridge 20 is inserted in the image forming apparatus main body M and located at an image forming operating position.

Tip Position of Developing Blade

Figure 23:
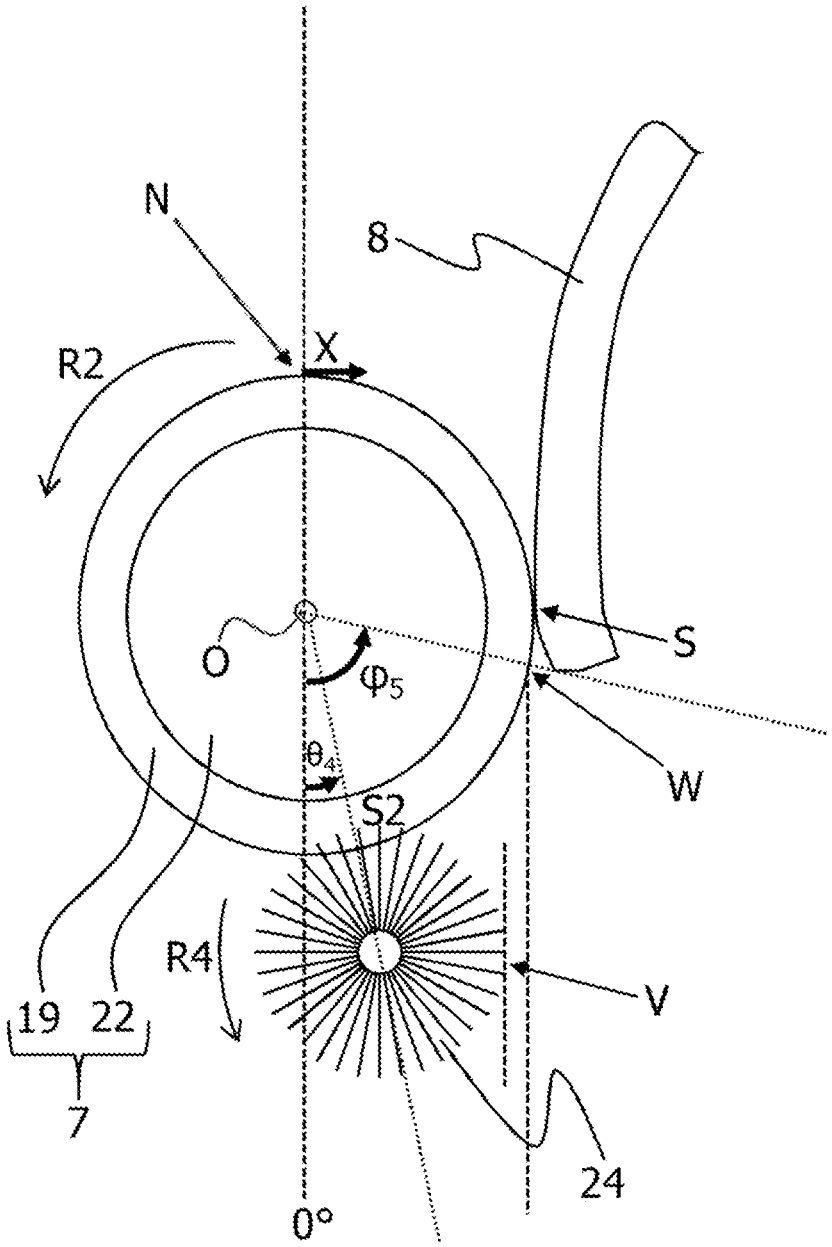
FIG. 23 is an explanatory diagram of the tip position of a developing blade in a fifth embodiment.

As illustrated in FIG. 23, the developing blade 8 in the fifth embodiment is defined such that the center of the magnet roller 22 is the origin of polar coordinates, the vertically downward direction from the origin is 0°, and the angle increases from 0° in the counterclockwise direction. An angle $\varphi_5$ of the tip position of the developing blade 8 on the free end side in the fifth embodiment is 80°. It is assumed that the upstream direction in the rotation direction of the developing roller 7, which is a horizontal direction from a point N located on the vertically uppermost side on the peripheral surface of the developing roller 7, is an X direction. In the configuration in the fifth embodiment, a point S present farthest in the X direction among points present on the peripheral surface of the developing roller 7 is present toward the X direction side than a point W closest to the tip position of the developing blade 8 among points present on the peripheral surface of the developing roller 7. The point W is present on a side more upstream than the point S in the rotation direction of the developing roller 7. The point W is present toward the X direction side than a point V present farthest in the X direction among points present on the outer circumference of the brush roller 24. Thus, the point V, the point W, and the point S are present in the order of the point V, the point W, and the point S in the X direction. The point N is an example of "first point located on the vertically uppermost side on the peripheral surface of the developer bearing member". The X direction is an example of "upstream direction (first direction) in rotation direction of developer bearing member, which is horizontal direction from first point". The point W is an example of "second point closest to tip position of restricting member on peripheral surface of developer bearing member". The point S is an example of "third point present farthest in first direction on peripheral surface on developer bearing member". The point V is an example of "fourth point present farthest in first direction on peripheral surface of moving member".

Effects in the Fifth Embodiment

Figure 24:
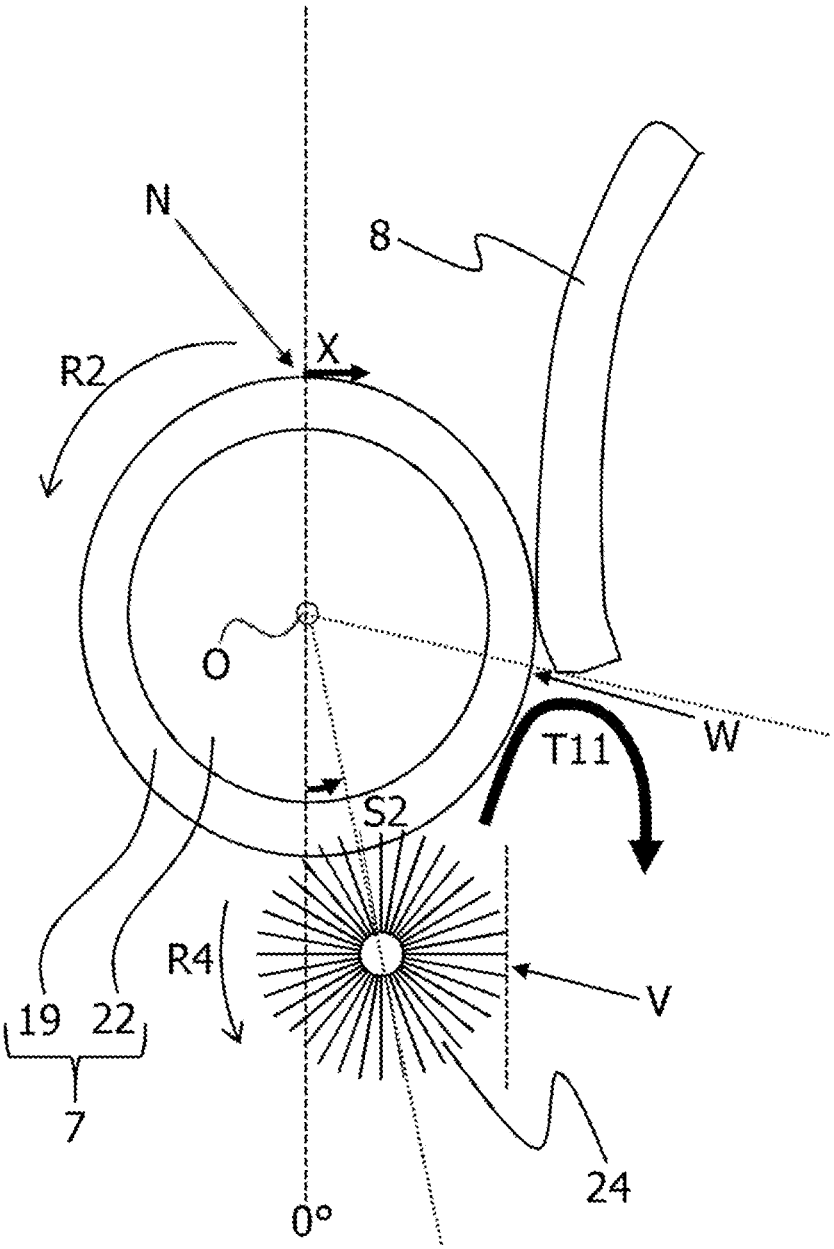
FIG. 24 is an explanatory diagram of the circulation of toner in the fifth embodiment.

The circulation of toner 3 in the fifth embodiment is described with reference to FIG. 24. The configuration in the fifth embodiment is different from the configuration in the fourth embodiment in that the tip position of the developing blade 8 is located on a side more upstream than the point S in the rotation direction of the developing roller 7. Thus, the toner 3 is restricted by the developing blade 8 before the point S, and the toner 3 is stripped from the developing roller 7 (T11). The point W is present farther in the X direction than the point V present farthest in the X direction among points present on the outer circumference of the brush roller 24, and hence the stripped toner 3 is directly stored in the toner storing chamber 40. The specific effects in the fifth embodiment are described with reference to Table 5.

TABLE 5

| | Initial use of process cartridge | | After printing of 50,000 sheets | |
|---|---|---|---|---|
| | Configuration in Fourth Embodiment | Configuration in Fifth Embodiment | Configuration in Fourth Embodiment | Configuration in Fifth Embodiment |
| Toner sticking (restriction failure) | Good | Good | Ordinary | Good |
| Toner stripped (fogging) | Good | Good | Good | Good |

In Table 5, the moving effect and the stripping suppressing effect of the brush roller 24 is compared between the configuration in the fourth embodiment and the configuration in the fifth embodiment. Also in the fifth embodiment, the moving effect and the stripping suppressing effect comparable to the fourth embodiment are obtained. Also in the configuration in the fifth embodiment, similarly to the configuration in the fourth embodiment, the toner 3 supplied from the toner storing chamber 40 does not enter between the brush fibers 24*a*, but the toner 3 is restricted by the developing blade 8 and returns to the toner storing chamber 40 again. In other words, the circulation of the toner 3 in the configuration in the fifth embodiment is similar to the circulation of the toner 3 in the configuration in the fourth embodiment, and hence it is considered that the fifth embodiment has successfully obtained the effects similar to those in the fourth embodiment.

There may be a case where the developing blade 8 is required to be brought into contact with the developing roller 7 at a lower position than in the configuration in the fourth embodiment due to an apparatus configurational reason that the size of the image forming apparatus main body M needs to be decreased. Even in such a case, the configuration in the fifth embodiment can maintain and improve the moving effect of the brush roller 24 while suppressing the stripping of the toner 3. The configuration in the fifth embodiment can be applied to the configurations in the first to third embodiments.

Sixth Embodiment

Figure 25A:
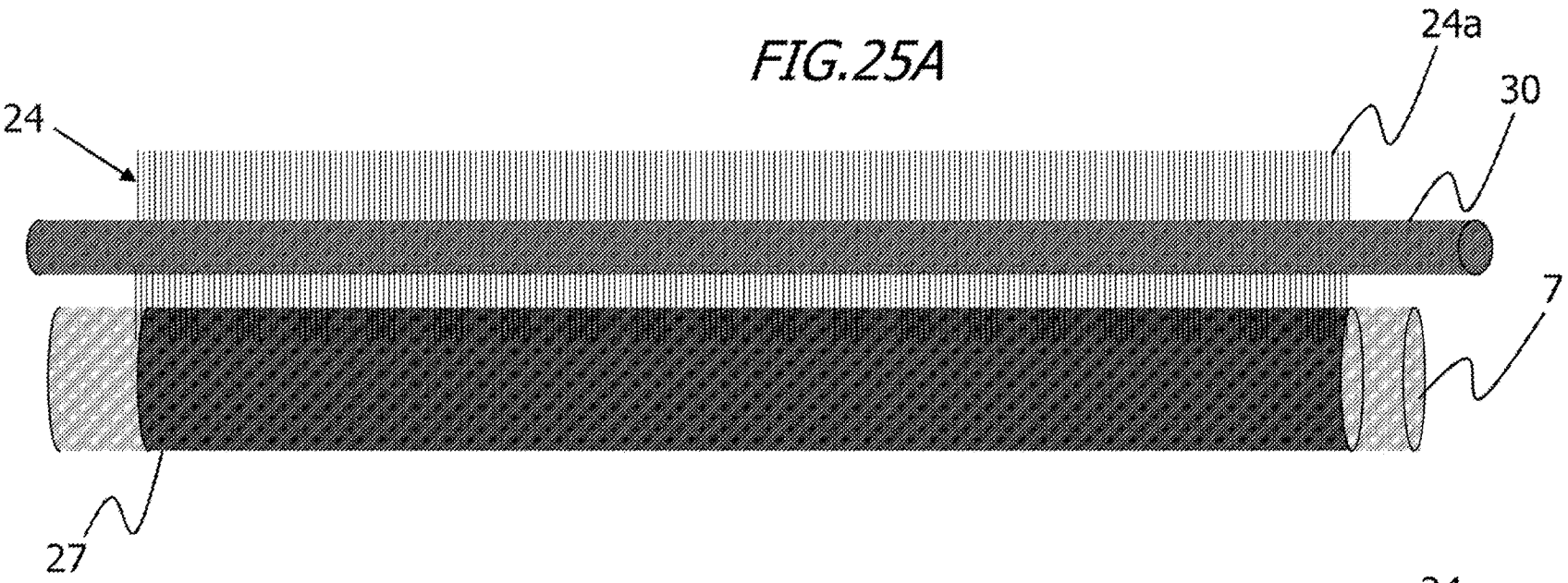
FIGS. 25A and 25B are explanatory diagrams when the brush roller in each of the embodiments is in contact with the developing roller.
Figure 25B:
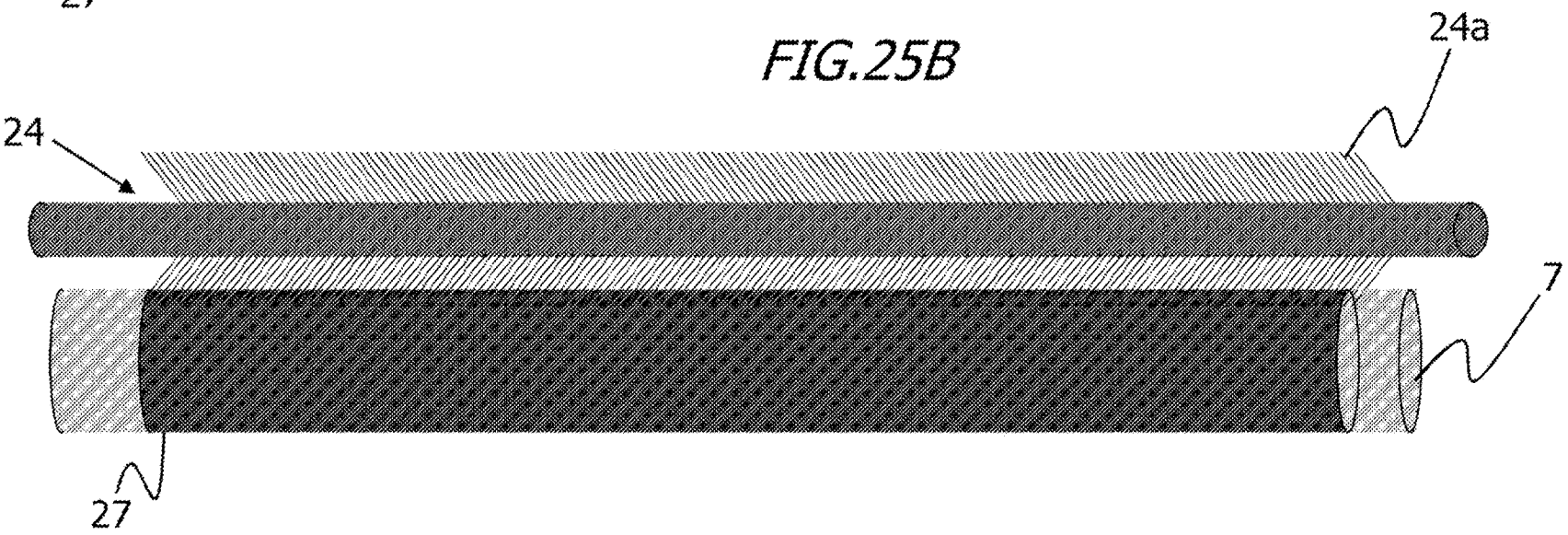

In the second to fifth embodiments, the brush roller 24 as a moving member is used. In the second to fifth embodiments, as illustrated in FIG. 25A, the brush roller 24 in which the brush fibers 24*a* are transplanted perpendicularly to the surface of the shaft 30 is used. Specifically, when at least one of the developing roller 7 and the brush roller 24 is rotationally driven, the tip of the brush fiber 24*a* is in contact with the developing roller surface 27 while being inclined in the rotation direction of the developing roller 7. The sixth embodiment aims at achieving a more efficient moving effect of the lowermost layer toner 28 of the magnetic chains 25 and uniformizing the toner coat in the longitudinal direction, and has a configuration in which, as illustrated in FIG. 25B, the tip of the brush fiber 24*a* is in contact with the developing roller surface 27 while being inclined in the rotation axis direction of the developing roller 7.

Figure 26A:
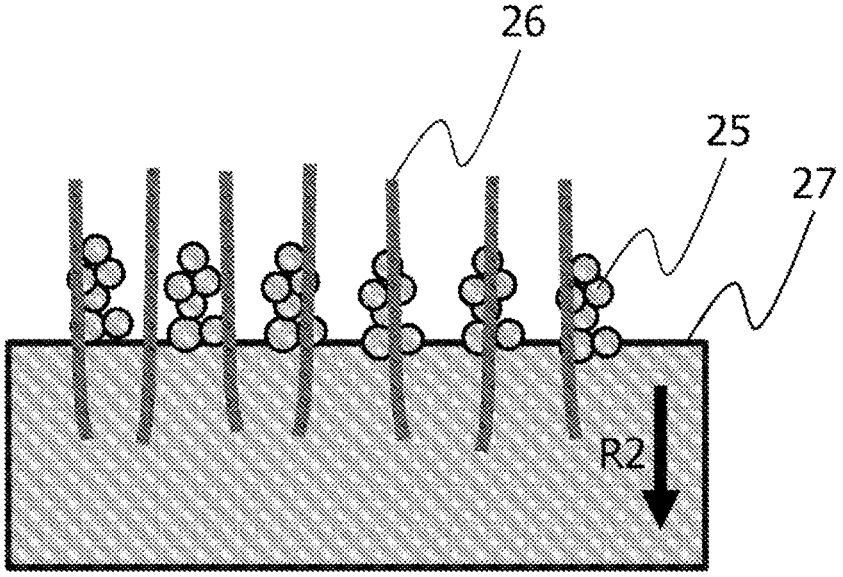
FIGS. 26A and 26B are explanatory diagrams of the movement of toner by the brush roller.
Figure 26B:
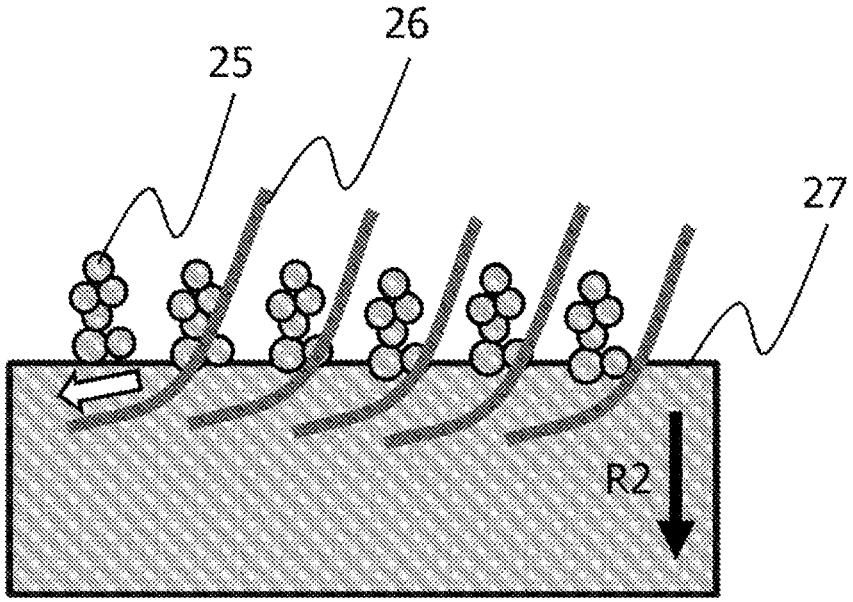

An effect mechanism in the sixth embodiment is described with reference to FIGS. 26A and 26B. FIG. 26A illustrates the configuration of the brush roller 24 used in the second to fifth embodiments. In the configuration of the brush roller 24 illustrated in FIG. 26A, the brush tip 26 is oriented in the vertical direction from the surface of the shaft 30, and hence the brush tip 26 is oriented in the rotation direction (arrow R2) of the developing roller 7 when the developing roller 7 rotates. FIG. 26B illustrates a configuration of the brush roller 24 used in the sixth embodiment. In the configuration of the brush roller 24 illustrated in FIG. 26B, the brush tip 26 is oriented in a direction inclined with respect to the rotation axis direction of the developing roller 7, and hence the area in which the brush roller 24 is in contact with the developing roller surface 27 increases. As a result, the lowermost layer toner 28 of the magnetic chains 25 can be moved so as to be scratched by the brush tip 26. The rotation axis direction of the developing roller 7 is a direction orthogonal to the rotation direction of the developing roller 7.

The brush tip 26 is in contact with the developing roller surface 27 while being inclined in the rotation axis direction of the developing roller 7. Thus, the magnetic chains 25 slightly move on the developing roller surface 27 along a profile locus of the inclined brush tip 26 (toward white arrow direction in FIG. 26B) while the lowermost layer toner 28 of the magnetic chains 25 which is in contact with the brush tip 26 is collapsed. Specifically, the toner 3 slightly moves in the longitudinal direction of the developing roller 7. The longitudinal direction of the developing roller 7 is a direction orthogonal to the rotation direction of the developing roller 7. When the developing roller 7 rotates, the micromovement of the toner 3 in the longitudinal direction of the developing roller 7 is repeated. By uniformizing the toner coat state in the longitudinal direction of the developing roller 7, the toner layers on the developing roller 7 can be made uniform.

The brush tip 26 comes into contact with the developing roller 7 while being inclined in the rotation axis direction of the developing roller 7, and hence the lowermost layer toner 28 of the magnetic chains 25 is moved by the brush tip 26 with a wider area. Consequently, the toner 3 having high charge amount can be more efficiently prevented from sticking to the developing roller surface 27. In addition, the toner 3 on the developing roller 7 is moved in the longitudinal direction of the developing roller 7, and hence the charged state of the toner 3, the toner coat thickness, and the degradation state of the toner 3 can be made uniform.

In the sixth embodiment, the orientation of the inclination of the brush tip 26 when the brush tip 26 comes into contact with the developing roller surface 27 may be either of right and left. The brush tip 26 only needs to be oriented to the axial direction side of the rotation direction of the developing roller 7 at least when the developing roller 7 and the brush roller 24 are rotationally driven with a peripheral speed difference. The orientation of the inclination of the brush tip 26 in the rotation axis direction of the developing roller 7 may cause longitudinal image density unevenness in an image forming region. Thus, it is desired that the rotating axis of the developing roller 7 and the inclination of the brush tip 26 be orientated in the same direction, but this is not necessary at an end portion of the developing roller 7. On the other hand, when the toner 3 move to the longitudinal inner side of the developing roller 7, the toner coat thickness becomes nonuniform at an end point of the movement of the toner 3 in the longitudinal direction of the developing roller 7. Thus, it is desired to move the toner 3 to the longitudinal outer side of the developing roller 7.

The toner 3 that has moved to an extreme end portion due to the contact of the inclined brush tip 26 with the developing roller 7 is restricted and scraped by the developing blade 8. In addition, if a stripping member made of a sponge roller mentioned in the conventional example comes into contact with a side outer wall of the longitudinal end portion of the developing roller 7, the sponge roller itself is scraped, and hence the moving effect cannot be provided up to the extreme end portion of toner coat on the developing roller 7. On the other hand, in the sixth embodiment using the brush roller 24, the brush roller 24 can be brought into contact with a side outer wall of the longitudinal end portion of the developing roller 7. In other words, according to the sixth embodiment, the moving effect can be provided up to an extreme end portion of toner coat on the developing roller 7. Thus, the toner 3 that has moved to the longitudinal extreme end portion on the developing roller surface 27 can maintain a proper toner coat state due to the scraping by the developing blade 8 and the movement by the brush roller 24. The configuration in the sixth embodiment can provide a more effective moving effect than in the first to fifth embodiments, and can improve the longitudinal uniformity of the toner coat on the developing roller 7. The tip of the brush fiber included in the brush 23 in the first embodiment may come into contact with the developing roller 7 while being inclined in the rotation axis direction of the developing roller 7. Thus, an effective moving effect can be provided also in the configuration in the first embodiment.

According to the disclosure described above, the sticking of a developer to the surface of a developer bearing member can be suppressed while maintaining charge amount of the developer necessary for forming high-quality images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-098745, filed on May 23, 2018, which is hereby incorporated by reference herein in its entirety.

What is claimed is:

1. A developing apparatus, comprising:

a rotatable developer bearing member that encloses a magnet roller having a plurality of magnetic poles;

a wall that forms a developer storing chamber for storing a magnetic developer therein;

a restricting member, having one end fixed to the wall and an other end opposite to the one end being capable of contacting the developer bearing member, and configured to restrict a layer thickness of the magnetic developer carried by the developer bearing member; and a moving member, positioned at an upstream side of the restricting member in relation to a rotation direction of the developer bearing member, and configured to move the magnetic developer carried on the developer bearing member before the magnetic developer is restricted by the restricting member, the moving member contacting with a surface of the developer bearing member, the moved developer remaining on the developer bearing member after the moving member moves the developer on the developer bearing member, wherein the moving member contacts the surface of the developer bearing member at a contact position opposed to any of the magnetic pole positions of the plurality of magnetic poles.

2. The developing apparatus according to claim 1, wherein the moving member has a plurality of fibers, and each of the plurality of fibers has one end fixed to the moving member and another end being a free end.

3. The developing apparatus according to claim 2, wherein a relation among a magnetic attractive force of the magnet roller on the magnetic developer, a linear pressure of the restricting member at a contact position between the developer bearing member and the restricting member, and a linear pressure of the moving member at the contact position between the developer bearing member and the moving member satisfies the following formula: (the magnetic attractive force of the magnet roller on the magnetic developer at the contact position between the developer bearing member and the restricting member/the linear pressure of the restricting member at the contact position between the developer bearing member and the restricting member)<(the magnetic attractive force of the magnet roller on the magnetic developer at the contact position between the developer bearing member and the moving member/the linear pressure of the moving member at the contact position between the developer bearing member and the moving member).

4. The developing apparatus according to claim 2, wherein the moving member is disposed on a vertically lower side of the developer bearing member, a surface of the developer in the developer storing chamber is present on a vertically lower side of the contact position between the developer bearing member and the moving member, and the moving member and an end portion of the developer bearing member on an upstream side in the rotation direction of the developer bearing member do not overlap each other in a vertical direction.

5. The developing apparatus according to claim 4, wherein when an upstream direction of the rotation direction of the developer bearing member, which is a horizontal direction from a first point located on a vertically uppermost side on a peripheral surface of the developer bearing member, is a first direction, a second point closest to a tip position of the restricting member on the peripheral surface of the developer bearing member is present on a side more downstream than a third point, which is present farthest in the first direction on the peripheral surface of the developer bearing member, in the rotation direction of the developer bearing member, and the third point is present toward the first direction side than a fourth point present farthest in the first direction on a peripheral surface of the moving member.

6. The developing apparatus according to claim 4, wherein when an upstream direction of the rotation direction of the developer bearing member, which is a horizontal direction from a first point located on a vertically uppermost side on a peripheral surface of the developer bearing member, is a first direction, a second point closest to a tip position of the restricting member on the peripheral surface of the developer bearing member is present on a side more upstream than a third point, which is present farthest in the first direction on the peripheral surface of the developer bearing member, in the rotation direction of the developer bearing member, and the second point is present toward the first direction side than a fourth point present farthest in the first direction on a peripheral surface of the moving member.

7. The developing apparatus according to claim 1, wherein the moving member is rotatable, and the developer bearing member and the moving member rotate in opposite directions at the contact position between the developer bearing member and the moving member.

8. The developing apparatus according to claim 1, wherein the moving member is rotatable, and the developer bearing member and the moving member rotate in the same direction at the contact position between the developer bearing member and the moving member.

9. The developing apparatus according to claim 1, wherein the moving member is rotatable, and the moving member is in contact with a part of an inner wall of the developer storing chamber.

10. The developing apparatus according to claim 1, wherein a vertical component of a magnetic force of the magnet roller on the magnetic developer at a position closest to the developer bearing member on a peripheral surface of a rotating shaft of the moving member is larger than a value obtained by multiplying a weight of the magnetic developer by an acceleration of gravity.

11. The developing apparatus according to claim 2, wherein a tip of the fiber is in contact with the developer bearing member while being inclined in a rotation axis direction of the developer bearing member.

12. The developing apparatus according to claim 1, wherein the moving member is a fixed fur brush.

13. The developing apparatus according to claim 12, wherein the fur brush has brush fiber, and a tip of the brush fiber is in contact with the developer bearing member while being inclined in a rotation axis direction of the developer bearing member.

14. A process cartridge to be removably provided to a main body of an image forming apparatus for forming an image, the process cartridge comprising:

the developing apparatus according to claim 1; and an image bearing member configured such that, when the magnetic developer is supplied from the developer bearing member, an electrostatic latent image formed on a surface of the image bearing member is developed, and a developer image is formed on the surface of the image bearing member.

15. An image forming apparatus, comprising:

the developing apparatus according to claim 1;

an image bearing member configured such that, when the magnetic developer is supplied from the developer bearing member, an electrostatic latent image formed on a surface of the image bearing member is developed, and a developer image is formed on the surface of the image bearing member; and a transfer unit configured to transfer the developer image developed on the image bearing member.

* * * * *